US008434325B2

(12) United States Patent
Martinez et al.

(10) Patent No.: US 8,434,325 B2
(45) Date of Patent: May 7, 2013

(54) LIQUEFIED NATURAL GAS AND HYDROCARBON GAS PROCESSING

(75) Inventors: Tony L. Martinez, Odessa, TX (US); John D. Wilkinson, Midland, TX (US); Hank M. Hudson, Midland, TX (US); Kyle T. Cuellar, Katy, TX (US)

(73) Assignee: Ortloff Engineers, Ltd., Midland, TX (US)

( * ) Notice: Subject to any disclaimer, the term of this patent is extended or adjusted under 35 U.S.C. 154(b) by 912 days.

(21) Appl. No.: 12/466,669

(22) Filed: May 15, 2009

(65) Prior Publication Data

US 2010/0287985 A1 Nov. 18, 2010
US 2012/0000246 A9 Jan. 5, 2012

(51) Int. Cl.
*F25J 3/00* (2006.01)
*F17C 9/02* (2006.01)

(52) U.S. Cl.
USPC ..... 62/620; 62/630; 62/50.2

(58) Field of Classification Search ..... 62/617, 62/618, 619, 620, 625, 630, 634, 635, 50.2
See application file for complete search history.

(56) References Cited

U.S. PATENT DOCUMENTS 33,408 A 10/1861 Turner et al. ..... 68/22 R
2,952,984 A 9/1960 Marshall, Jr. ..... 62/622

(Continued)

FOREIGN PATENT DOCUMENTS

FR 1535846 8/1968
WO WO 01/88447 A1 11/2001

(Continued)

OTHER PUBLICATIONS

Finn, Adrian J., Grant L. Johnson, and Terry R. Tomilson, "LNG Technology for Offshore and Mid-Scale Plants", Proceedings of the Seventy-Ninth Annual Convention of the Gas Processors Association, pp. 429-450, Atlanta, Georgia, Mar. 13-15, 2000.

(Continued)

*Primary Examiner* — John F Pettitt
*Assistant Examiner* — Ignacio E Landeros
(74) *Attorney, Agent, or Firm* — Fitzpatrick, Cella, Harper & Scinto

(57) ABSTRACT

A process for the recovery of heavier hydrocarbons from a liquefied natural gas (LNG) stream and a hydrocarbon gas stream is disclosed. The LNG feed stream is heated to vaporize at least part of it, then expanded and supplied to a fractionation column at a first mid-column feed position. The gas stream is expanded and cooled, then supplied to the column at a second mid-column feed position. A distillation vapor stream is withdrawn from the fractionation column below the mid-column feed positions and directed in heat exchange relation with the LNG feed stream, cooling the distillation vapor stream as it supplies at least part of the heating of the LNG feed stream. The distillation vapor stream is cooled sufficiently to condense at least a part of it, forming a condensed stream. At least a portion of the condensed stream is directed to the fractionation column as its top feed. A portion of the column overhead stream is also directed in heat exchange relation with the LNG feed stream, so that it also supplies at least part of the heating of the LNG feed stream as it is condensed to form a "lean" LNG stream. The quantities and temperatures of the feeds to the column are effective to maintain the column overhead temperature at a temperature whereby the major portion of the desired components is recovered in the bottom liquid product from the column.

34 Claims, 8 Drawing Sheets

U.S. PATENT DOCUMENTS

| | | | | |
|---|---|---|---|---|
| 3,292,380 | A | 12/1966 | Bucklin | 62/621 |
| 3,724,226 | A | 4/1973 | Pachaly | 62/613 |
| 3,763,658 | A | 10/1973 | Gaumer, Jr. et al. | 62/612 |
| 3,837,172 | A | 9/1974 | Markbriter et al. | 62/621 |
| 4,033,735 | A | 7/1977 | Swenson | 62/612 |
| 4,061,481 | A | 12/1977 | Campbell et al. | 62/621 |
| 4,065,278 | A | 12/1977 | Newton et al. | 62/622 |
| 4,140,504 | A | 2/1979 | Campbell et al. | 62/621 |
| 4,157,904 | A | 6/1979 | Campbell et al. | 62/623 |
| 4,171,964 | A | 10/1979 | Campbell et al. | 62/621 |
| 4,185,978 | A | 1/1980 | McGalliard et al. | 62/634 |
| 4,251,249 | A | 2/1981 | Gulsby | 62/621 |
| 4,278,457 | A | 7/1981 | Campbell et al. | 62/621 |
| 4,368,061 | A | 1/1983 | Mestrallet et al. | 62/630 |
| 4,404,008 | A | 9/1983 | Rentler et al. | 62/612 |
| 4,430,103 | A | 2/1984 | Gray et al. | 62/620 |
| 4,445,916 | A | 5/1984 | Newton | 62/625 |
| 4,445,917 | A | 5/1984 | Chiu | 62/625 |
| 4,519,824 | A | 5/1985 | Huebel | 62/621 |
| 4,525,185 | A | 6/1985 | Newton | 62/612 |
| 4,545,795 | A | 10/1985 | Liu et al. | 62/613 |
| 4,592,766 | A | 6/1986 | Kumman et al. | 62/621 |
| 4,596,588 | A | 6/1986 | Cook | 62/621 |
| 4,600,421 | A | 7/1986 | Kummann | 62/621 |
| 4,617,039 | A | 10/1986 | Buck | 62/621 |
| 4,657,571 | A | 4/1987 | Gazzi | 62/621 |
| 4,676,812 | A | 6/1987 | Kummann | 62/622 |
| 4,687,499 | A | 8/1987 | Aghili | 62/621 |
| 4,689,063 | A | 8/1987 | Paradowski et al. | 62/627 |
| 4,690,702 | A | 9/1987 | Paradowski et al. | 62/621 |
| 4,698,081 | A | 10/1987 | Aghili | 62/24 |
| 4,707,170 | A | 11/1987 | Ayres et al. | 62/627 |
| 4,710,214 | A | 12/1987 | Sharma et al. | 62/621 |
| 4,711,651 | A | 12/1987 | Sharma et al. | 62/621 |
| 4,718,927 | A | 1/1988 | Bauer et al. | 62/621 |
| 4,720,294 | A | 1/1988 | Lucadamo et al. | 62/627 |
| 4,738,699 | A | 4/1988 | Apffel | 62/623 |
| 4,752,312 | A | 6/1988 | Prible | 62/622 |
| 4,755,200 | A | 7/1988 | Liu et al. | 62/612 |
| 4,793,841 | A | 12/1988 | Burr | 62/624 |
| 4,851,020 | A | 7/1989 | Montgomery, IV | 62/621 |
| 4,854,955 | A | 8/1989 | Campbell et al. | 62/621 |
| 4,869,740 | A | 9/1989 | Campbell et al. | 62/621 |
| 4,881,960 | A | 11/1989 | Ranke et al. | 62/632 |
| 4,889,545 | A | 12/1989 | Campbell et al. | 62/621 |
| 4,895,584 | A | 1/1990 | Buck et al. | 62/621 |
| 4,970,867 | A | 11/1990 | Herron et al. | 62/613 |
| 5,114,451 | A | 5/1992 | Rambo et al. | 62/623 |
| 5,114,541 | A | 5/1992 | Bayer | 201/2.5 |
| 5,275,005 | A | 1/1994 | Campbell et al. | 62/621 |
| 5,291,736 | A | 3/1994 | Paradowski | 62/613 |
| 5,325,673 | A | 7/1994 | Durr et al. | 62/634 |
| 5,363,655 | A | 11/1994 | Kikkawa et al. | 62/613 |
| 5,365,740 | A | 11/1994 | Kikkawa et al. | 62/613 |
| 5,537,827 | A | 7/1996 | Low et al. | 62/613 |
| 5,555,748 | A | 9/1996 | Campbell et al. | 62/621 |
| 5,566,554 | A | 10/1996 | Vijayaraghavan et al. | 62/621 |
| 5,568,737 | A | 10/1996 | Campbell et al. | 62/621 |
| 5,600,969 | A | 2/1997 | Low | 62/622 |
| 5,615,561 | A | 4/1997 | Houshmand et al. | 62/611 |
| 5,651,269 | A | 7/1997 | Prevost et al. | 62/613 |
| 5,669,234 | A | 9/1997 | Houser et al. | 62/612 |
| 5,685,170 | A | 11/1997 | Sorensen | 62/625 |
| 5,737,940 | A | 4/1998 | Yao et al. | 62/620 |
| 5,755,114 | A | 5/1998 | Foglietta | 62/618 |
| 5,755,115 | A | 5/1998 | Manley | 62/620 |
| 5,771,712 | A | 6/1998 | Campbell et al. | 62/621 |
| 5,799,507 | A | 9/1998 | Wilkinson et al. | 62/621 |
| 5,881,569 | A | 3/1999 | Campbell et al. | 62/621 |
| 5,890,378 | A | 4/1999 | Rambo et al. | 62/621 |
| 5,893,274 | A | 4/1999 | Nagelvoort et al. | 62/613 |
| 5,950,453 | A | 9/1999 | Bowen et al. | 62/612 |
| 5,983,664 | A | 11/1999 | Campbell et al. | 62/621 |
| 6,014,869 | A | 1/2000 | Elion et al. | 62/621 |
| 6,016,665 | A | 1/2000 | Cole et al. | 62/612 |
| 6,023,942 | A | 2/2000 | Thomas et al. | 62/613 |
| 6,053,007 | A | 4/2000 | Victory et al. | 62/619 |
| 6,062,041 | A | 5/2000 | Kikkawa et al. | 62/613 |
| 6,116,050 | A | 9/2000 | Yao et al. | 62/630 |
| 6,119,479 | A | 9/2000 | Roberts et al. | 62/612 |
| 6,125,653 | A | 10/2000 | Shu et al. | 62/622 |
| 6,182,469 | B1 | 2/2001 | Campbell et al. | 62/621 |
| 6,250,105 | B1 | 6/2001 | Kimble | 62/613 |
| 6,269,655 | B1 | 8/2001 | Roberts et al. | 62/612 |
| 6,272,882 | B1 | 8/2001 | Hodges et al. | 62/613 |
| 6,308,531 | B1 | 10/2001 | Roberts et al. | 62/611 |
| 6,324,867 | B1 | 12/2001 | Fanning et al. | 62/613 |
| 6,336,344 | B1 | 1/2002 | O'Brien | 62/627 |
| 6,347,532 | B1 | 2/2002 | Agrawal et al. | 62/612 |
| 6,363,744 | B2 | 4/2002 | Finn et al. | 62/621 |
| 6,367,286 | B1 | 4/2002 | Price | 62/613 |
| 6,401,486 | B1 | 6/2002 | Lee et al. | 62/630 |
| 6,526,777 | B1 | 3/2003 | Campbell et al. | 62/621 |
| 6,578,379 | B2 | 6/2003 | Paradowski | 62/622 |
| 6,604,380 | B1 | 8/2003 | Reddick et al. | 62/620 |
| 6,712,880 | B2 | 3/2004 | Foglietta et al. | 95/184 |
| 6,742,358 | B2 | 6/2004 | Wilkinson et al. | 62/613 |
| 6,889,523 | B2 | 5/2005 | Wilkinson et al. | 62/613 |
| 6,907,752 | B2 | 6/2005 | Schroeder et al. | 62/620 |
| 6,915,662 | B2 | 7/2005 | Wilkinson et al. | 62/621 |
| 6,941,771 | B2 | 9/2005 | Reddick et al. | 62/620 |
| 6,945,075 | B2 | 9/2005 | Wilkinson et al. | 62/620 |
| 7,010,937 | B2 | 3/2006 | Wilkinson et al. | 62/613 |
| 7,069,743 | B2 | 7/2006 | Prim | 62/620 |
| 7,155,931 | B2 | 1/2007 | Wilkinson et al. | 62/620 |
| 7,191,617 | B2 | 3/2007 | Cuellar et al. | 62/628 |
| 7,204,100 | B2 | 4/2007 | Wilkinson et al. | 62/612 |
| 7,210,311 | B2 | 5/2007 | Wilkinson et al. | 62/611 |
| 7,216,507 | B2 | 5/2007 | Cuellar et al. | 62/620 |
| 7,219,513 | B1 | 5/2007 | Mostafa | 62/620 |
| 7,565,815 | B2 | 7/2009 | Wilkinson et al. | 62/613 |
| 2003/0005722 | A1 | 1/2003 | Wilkinson et al. | 62/613 |
| 2003/0158458 | A1 | 8/2003 | Prim | 585/800 |
| 2004/0079107 | A1 | 4/2004 | Wilkinson et al. | 62/611 |
| 2004/0177646 | A1* | 9/2004 | Wilkinson et al. | 62/614 |
| 2005/0061029 | A1 | 3/2005 | Narinsky | 62/620 |
| 2005/0066686 | A1 | 3/2005 | Wilkinson et al. | 62/620 |
| 2005/0155381 | A1 | 7/2005 | Yang et al. | 62/620 |
| 2006/0000234 | A1 | 1/2006 | Cuellar et al. | 62/620 |
| 2006/0032269 | A1 | 2/2006 | Cuellar et al. | 62/620 |
| 2006/0260356 | A1 | 11/2006 | Schroeder et al. | 62/620 |
| 2006/0277943 | A1 | 12/2006 | Yokohata et al. | 62/620 |
| 2007/0001322 | A1 | 1/2007 | Aikhorin et al. | 261/75 |

FOREIGN PATENT DOCUMENTS

| | | | |
|---|---|---|---|
| WO | WO 2004/109180 | A1 | 12/2004 |
| WO | WO 2005/015100 | A1 | 2/2005 |
| WO | WO 2005/035692 | A2 | 4/2005 |

OTHER PUBLICATIONS

Kikkawa, Yoshitsugi, Masaaki Ohishi, and Noriyoshi Nozawa, "Optimize the Power System of Baseload LNG Plant", Proceedings of the Eightieth Annual Convention of the Gas Processors Association, San Antonio, Texas, Mar. 12-14, 2001.

Price, Brian C., "LNG Production for Peak Shaving Operations", Proceedings of the Seventy-Eighth Annual Convention of the Gas Processors Association, pp. 273-280, Nashville, Tennessee, Mar. 1-3, 1999.

Huang et al., "Select the Optimum Extraction Method for LNG Regasification; Varying Energy Compositions of LNG Imports may Require Terminal Operators to Remove $C_2$+ Compounds before Injecting Regasified LNG into Pipelines", *Hydrocarbon Processing*, 83, 57-62, Jul. 2004.

Yang et al., "Cost-Effective Design Reduces $C_2$ and $C_3$ at LNG Receiving Terminals", *Oil & Gas Journal*, 50-53, May 26, 2003.

* cited by examiner

LIQUEFIED NATURAL GAS AND HYDROCARBON GAS PROCESSING

BACKGROUND OF THE INVENTION

This invention relates to a process for the separation of ethane and heavier hydrocarbons or propane and heavier hydrocarbons from liquefied natural gas (hereinafter referred to as LNG) combined with the separation of a gas containing hydrocarbons to provide a volatile methane-rich gas stream and a less volatile natural gas liquids (NGL) or liquefied petroleum gas (LPG) stream.

As an alternative to transportation in pipelines, natural gas at remote locations is sometimes liquefied and transported in special LNG tankers to appropriate LNG receiving and storage terminals. The LNG can then be re-vaporized and used as a gaseous fuel in the same fashion as natural gas. Although LNG usually has a major proportion of methane, i.e., methane comprises at least 50 mole percent of the LNG, it also contains relatively lesser amounts of heavier hydrocarbons such as ethane, propane, butanes, and the like, as well as nitrogen. It is often necessary to separate some or all of the heavier hydrocarbons from the methane in the LNG so that the gaseous fuel resulting from vaporizing the LNG conforms to pipeline specifications for heating value. In addition, it is often also desirable to separate the heavier hydrocarbons from the methane and ethane because these hydrocarbons have a higher value as liquid products (for use as petrochemical feedstocks, as an example) than their value as fuel.

Although there are many processes which may be used to separate ethane and/or propane and heavier hydrocarbons from LNG, these processes often must compromise between high recovery, low utility costs, and process simplicity (and hence low capital investment). U.S. Pat. Nos. 2,952,984; 3,837,172; 5,114,451; and 7,155,931 describe relevant LNG processes capable of ethane or propane recovery while producing the lean LNG as a vapor stream that is thereafter compressed to delivery pressure to enter a gas distribution network. However, lower utility costs may be possible if the lean LNG is instead produced as a liquid stream that can be pumped (rather than compressed) to the delivery pressure of the gas distribution network, with the lean LNG subsequently vaporized using a low level source of external heat or other means. U.S. Pat. Nos. 6,604,380; 6,907,752; 6,941,771; 7,069,743; and 7,216,507 and co-pending application Ser. Nos. 11/749,268 and 12/060,362 describe such processes.

Economics and logistics often dictate that LNG receiving terminals be located close to the natural gas transmission lines that will transport the re-vaporized LNG to consumers. In many cases, these areas also have plants for processing natural gas produced in the region to recover the heavier hydrocarbons contained in the natural gas. Available processes for separating these heavier hydrocarbons include those based upon cooling and refrigeration of gas, oil absorption, and refrigerated oil absorption. Additionally, cryogenic processes have become popular because of the availability of economical equipment that produces power while simultaneously expanding and extracting heat from the gas being processed. Depending upon the pressure of the gas source, the richness (ethane, ethylene, and heavier hydrocarbons content) of the gas, and the desired end products, each of these processes or a combination thereof may be employed.

The cryogenic expansion process is now generally preferred for natural gas liquids recovery because it provides maximum simplicity with ease of startup, operating flexibility, good efficiency, safety, and good reliability. U.S. Pat. Nos. 3,292,380; 4,061,481; 4,140,504; 4,157,904; 4,171,964; 4,185,978; 4,251,249; 4,278,457; 4,519,824; 4,617,039; 4,687,499; 4,689,063; 4,690,702; 4,854,955; 4,869,740; 4,889,545; 5,275,005; 5,555,748; 5,566,554; 5,568,737; 5,771,712; 5,799,507; 5,881,569; 5,890,378; 5,983,664; 6,182,469; 6,578,379; 6,712,880; 6,915,662; 7,191,617; 7,219,513; reissue U.S. Pat. No. 33,408; and co-pending application Ser. Nos. 11/430,412; 11/839,693; 11/971,491; and 12/206,230 describe relevant processes (although the description of the present invention is based on different processing conditions than those described in the cited U.S. patents).

The present invention is generally concerned with the integrated recovery of propylene, propane, and heavier hydrocarbons from such LNG and gas streams. It uses a novel process arrangement to integrate the heating of the LNG stream and the cooling of the gas stream to eliminate the need for a separate vaporizer and the need for external refrigeration, allowing high $C_3$ component recovery while keeping the processing equipment simple and the capital investment low. Further, the present invention offers a reduction in the utilities (power and heat) required to process the LNG and gas streams, resulting in lower operating costs than other processes, and also offering significant reduction in capital investment.

Heretofore, assignee's co-pending application Ser. No. 12/060,362 could be used to recover $C_3$ components and heavier hydrocarbon components in plants processing LNG, while assignee's U.S. Pat. No. 5,799,507 has been used to recover $C_3$ components and heavier hydrocarbon components in plants processing natural gas. Surprisingly, applicants have found that by integrating certain features of the assignee's co-pending application Ser. No. 12/060,362 with certain features of the assignee's U.S. Pat. No. 5,799,507, extremely high $C_3$ component recovery levels can be accomplished using less energy than that required by individual plants to process the LNG and natural gas separately.

A typical analysis of an LNG stream to be processed in accordance with this invention would be, in approximate mole percent, 92.2% methane, 6.0% ethane and other $C_2$ components, 1.1% propane and other $C_3$ components, and traces of butanes plus, with the balance made up of nitrogen. A typical analysis of a gas stream to be processed in accordance with this invention would be, in approximate mole percent, 80.1% methane, 9.5% ethane and other $C_2$ components, 5.6% propane and other $C_3$ components, 1.3% isobutane, 1.1% normal butane, 0.8% pentanes plus, with the balance made up of nitrogen and carbon dioxide. Sulfur containing gases are also sometimes present.

For a better understanding of the present invention, reference is made to the following examples and drawings. Referring to the drawings:

FIG. 1 is a flow diagram of a base case natural gas processing plant using LNG to provide its refrigeration;

FIG. 2 is a flow diagram of base case LNG and natural gas processing plants in accordance with co-pending application Ser. No. 12/060,362 and U.S. Pat. No. 5,799,507, respectively;

In the following explanation of the above figures, tables are provided summarizing flow rates calculated for representative process conditions. In the tables appearing herein, the values for flow rates (in moles per hour) have been rounded to the nearest whole number for convenience. The total stream rates shown in the tables include all non-hydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

For convenience, process parameters are reported in both the traditional British units and in the units of the Système International d'Unités (SI). The molar flow rates given in the tables may be interpreted as either pound moles per hour or kilogram moles per hour. The energy consumptions reported as horsepower (HP) and/or thousand British Thermal Units per hour (MBTU/Hr) correspond to the stated molar flow rates in pound moles per hour. The energy consumptions reported as kilowatts (kW) correspond to the stated molar flow rates in kilogram moles per hour.

Figure 1:
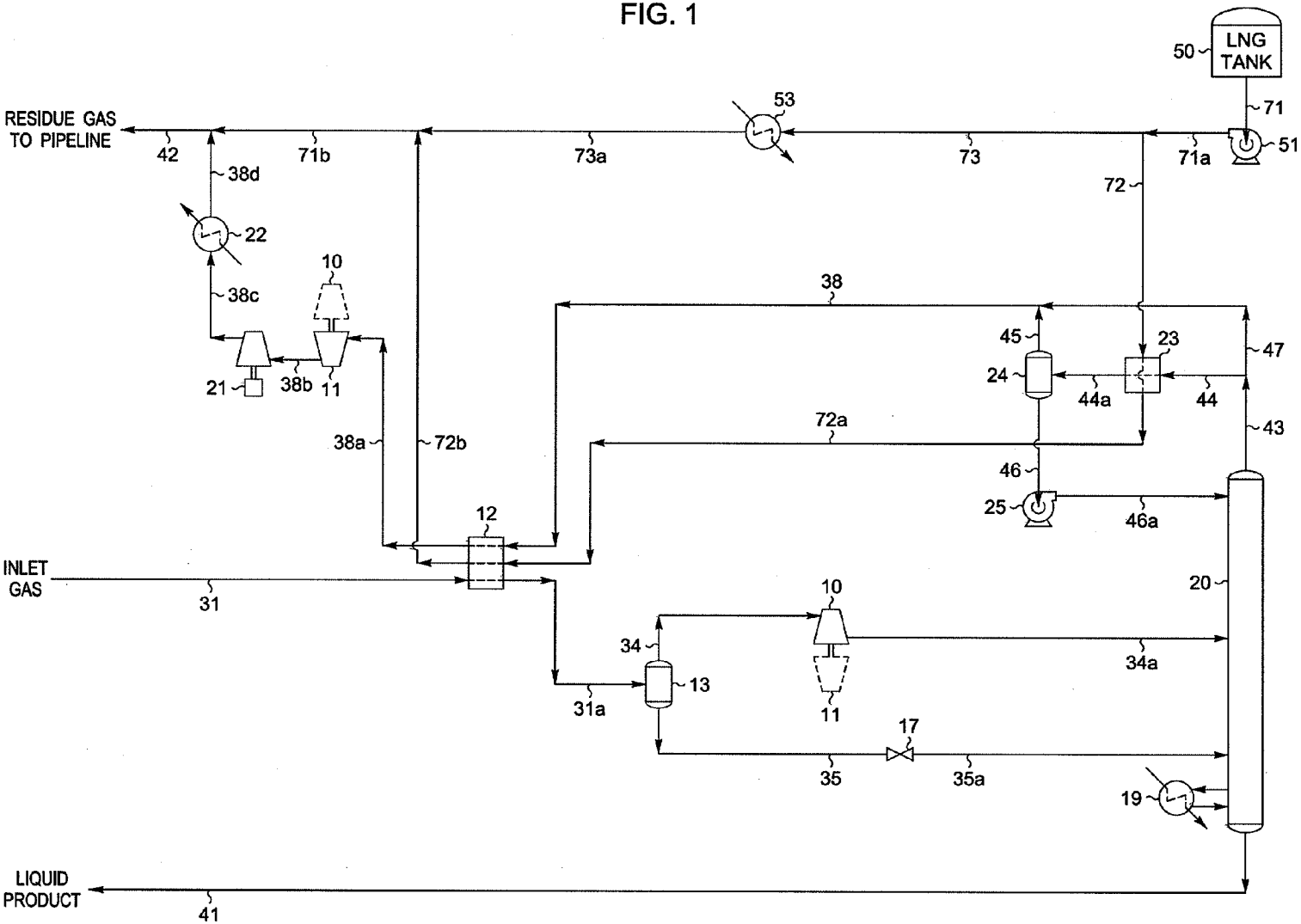
FIGS. 1 and 2 are provided to quantify the advantages of the present invention.

FIG. 1 is a flow diagram showing the design of a processing plant to recover $C_3$+ components from natural gas using an LNG stream to provide refrigeration. In the simulation of the FIG. 1 process, inlet gas enters the plant at 126° F. [52° C.] and 600 psia [4,137 kPa(a)] as stream 31. If the inlet gas contains a concentration of sulfur compounds which would prevent the product streams from meeting specifications, the sulfur compounds are removed by appropriate pretreatment of the feed gas (not illustrated). In addition, the feed stream is usually dehydrated to prevent hydrate (ice) formation under cryogenic conditions. Solid desiccant has typically been used for this purpose.

The inlet gas stream 31 is cooled in heat exchanger 12 by heat exchange with a portion (stream 72*a*) of partially warmed LNG at −173° F. [−114° C.] and cool residue vapor stream 38. The cooled stream 31*a* enters separator 13 at −76° F. [−60° C.] and 584 psia [4,027 kPa(a)] where the vapor (stream 34) is separated from the condensed liquid (stream 35). Liquid stream 35 is flash expanded through an appropriate expansion device, such as expansion valve 17, to the operating pressure (approximately 450 psia [3,101 kPa(a)]) of fractionation tower 20. The expanded stream 35*a* leaving expansion valve 17 reaches a temperature of −88° F. [−67° C.] and is supplied to fractionation tower 20 at a first mid-column feed point.

The vapor from separator 13 (stream 34) enters a work expansion machine 10 in which mechanical energy is extracted from this portion of the high pressure feed. The machine 10 expands the vapor substantially isentropically to the tower operating pressure, with the work expansion cooling the expanded stream 34*a* to a temperature of approximately −96° F. [−71° C.]. The typical commercially available expanders are capable of recovering on the order of 80-88% of the work theoretically available in an ideal isentropic expansion. The work recovered is often used to drive a centrifugal compressor (such as item 11) that can be used to re-compress the heated residue vapor (stream 38*a*), for example. The expanded stream 34*a* is supplied to fractionation tower 20 at a second mid-column feed point.

The deethanizer in tower 20 is a conventional distillation column containing a plurality of vertically spaced trays, one or more packed beds, or some combination of trays and packing to provide the necessary contact between the liquids falling downward and the vapors rising upward. The column also includes one or more reboilers (such as reboiler 19) which heat and vaporize a portion of the liquids flowing down the column to provide the stripping vapors which flow up the column to strip the liquid product, stream 41, of methane, $C_2$ components, and lighter components. Liquid product stream 41 exits the bottom of the tower at 210° F. [99° C.], based on a typical specification of an ethane to propane ratio of 0.020:1 on a molar basis in the bottom product.

Overhead distillation stream 43 is withdrawn from the upper section of fractionation tower 20 at −87° F. [−66° C.] and is divided into two portions, streams 44 and 47. The first portion, stream 44, flows to reflux condenser 23 where it is cooled to −237° F. [−149° C.] and totally condensed by heat exchange with a portion (stream 72) of the cold LNG (stream 71*a*). Condensed stream 44*a* enters reflux separator 24 wherein the condensed liquid (stream 46) is separated from any uncondensed vapor (stream 45). The liquid stream 46 from reflux separator 24 is pumped by reflux pump 25 to a pressure slightly above the operating pressure of deethanizer 20 and stream 46*a* is then supplied as cold top column feed (reflux) to deethanizer 20. This cold liquid reflux absorbs and condenses the $C_3$ components and heavier hydrocarbon components from the vapors rising in the upper section of deethanizer 20.

The second portion (stream 47) of overhead vapor stream 43 combines with any uncondensed vapor (stream 45) from reflux separator 24 to form cool residue vapor stream 38 at −88° F. [−67° C.]. Residue vapor stream 38 passes countercurrently to inlet gas in heat exchanger 12 where it is heated to −5° F. [−21° C.] (stream 38*a*). The residue vapor stream is then re-compressed in two stages. The first stage is compressor 11 driven by expansion machine 10. The second stage is compressor 21 driven by a supplemental power source which compresses stream 38*b* to sales line pressure (stream 38*c*). After cooling to 126° F. [52° C.] in discharge cooler 22, stream 38*d* combines with warm LNG stream 71*b* to form the residue gas product (stream 42). Residue gas stream 42 flows to the sales gas pipeline at 1262 psia [8,701 kPa(a)], sufficient to meet line requirements.

The LNG (stream 71) from LNG tank 50 enters pump 51 at −251° F. [−157° C.]. Pump 51 elevates the pressure of the LNG sufficiently so that it can flow through heat exchangers and thence to the sales gas pipeline. Stream 71*a* exits the pump 51 at −242° F. [−152° C.] and 1364 psia [9,404 kPa(a)] and is divided into two portions, streams 72 and 73. The first portion, stream 72, is heated as described previously to −173° F. [−114° C.] in reflux condenser 23 as it provides cooling to the portion (stream 44) of overhead vapor stream 43 from fractionation tower 20, and to 46° F. [8° C.] in heat exchanger 12 as it provides cooling to the inlet gas. The second portion, stream 73, is heated to 40° F. [4° C.] in heat exchanger 53 using low level utility heat. The heated streams 72*b* and 73*a* recombine to form warm LNG stream 71*b*, which thereafter combines with residue vapor stream 38*d* to form residue gas stream 42 as described previously.

A summary of stream flow rates and energy consumption for the process illustrated in FIG. 1 is set forth in the following table:

TABLE I (FIG. 1)
Stream Flow Summary - Lb. Moles/Hr [kg moles/Hr]

| Stream | Methane | Ethane | Propane | Butanes+ | Total |
|---|---|---|---|---|---|
| 31 | 42,545 | 5,048 | 2,972 | 1,658 | 53,145 |
| 34 | 34,289 | 1,744 | 313 | 45 | 37,216 |
| 35 | 8,256 | 3,304 | 2,659 | 1,613 | 15,929 |
| 43 | 49,015 | 5,747 | 20 | 0 | 55,843 |
| 44 | 6,470 | 758 | 3 | 0 | 7,371 |
| 45 | 0 | 0 | 0 | 0 | 0 |
| 46 | 6,470 | 758 | 3 | 0 | 7,371 |

TABLE I-continued

| (FIG. 1) Stream Flow Summary - Lb. Moles/Hr [kg moles/Hr] | | | | | |
|---|---|---|---|---|---|
| 47 | 42,545 | 4,989 | 17 | 0 | 48,472 |
| 38 | 42,545 | 4,989 | 17 | 0 | 48,472 |
| 71 | 40,293 | 2,642 | 491 | 3 | 43,689 |
| 72 | 31,429 | 2,061 | 383 | 2 | 34,077 |
| 73 | 8,864 | 581 | 108 | 1 | 9,612 |
| 42 | 82,838 | 7,631 | 508 | 3 | 92,161 |
| 41 | 0 | 59 | 2,955 | 1,658 | 4,673 |

| Recoveries* | | |
|---|---|---|
| Propane | 85.33% | |
| Butanes+ | 99.83% | |
| Power | | |
| LNG Feed Pump | 3,561 HP | [5,854 kW] |
| Reflux Pump | 21 HP | [35 kW] |
| Residue Gas Compressor | 21,779 HP | [35,804 kW] |
| Totals | 25,361 HP | [41,693 kW] |
| Low Level Utility Heat | | |
| LNG Heater | 48,190 MBTU/Hr | [31,128 kW] |
| High Level Utility Heat | | |
| Demethanizer Reboiler | 108,000 MBTU/Hr | [69,762 kW] |
| Specific Power | | |
| HP-Hr/Lb. Mole | 5.427 | |
| [kW-Hr/kg mole] | | [8.922] |

*(Based on un-rounded flow rates)

The recoveries reported in Table I are computed relative to the total quantities of propane and butanes+ contained in the gas stream being processed in the plant and in the LNG stream. Although the recoveries are quite high relative to the heavier hydrocarbons contained in the gas being processed (99.42% and 100.00%, respectively, for propane and butanes+), none of the heavier hydrocarbons contained in the LNG stream are captured in the FIG. 1 process. In fact, depending on the composition of LNG stream 71, the residue gas stream 42 produced by the FIG. 1 process may not meet all pipeline specifications. The specific power reported in Table I is the power consumed per unit of liquid product recovered, and is an indicator of the overall process efficiency.

Figure 2:
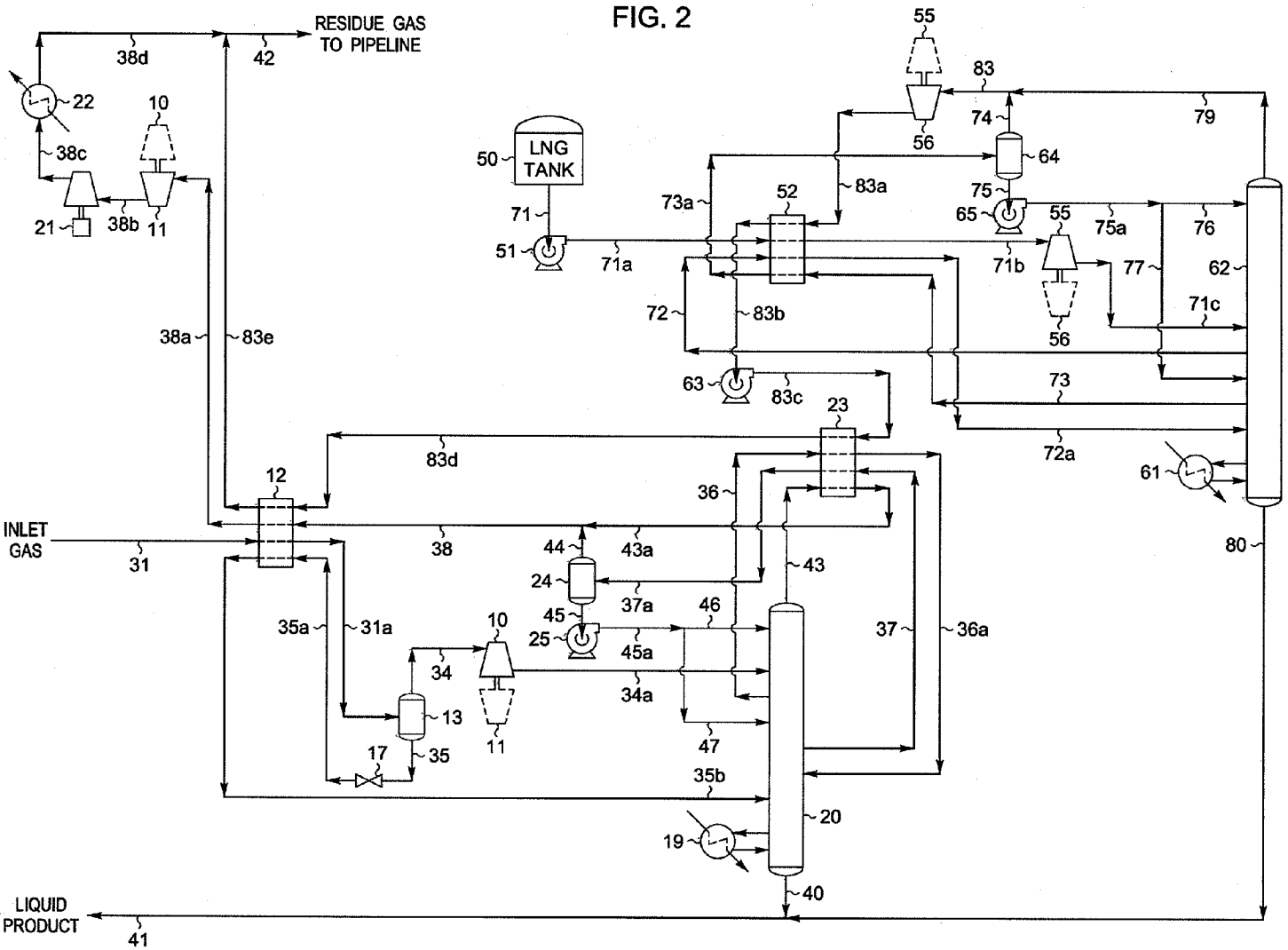

FIG. 2 is a flow diagram showing processes to recover $C_3$+ components from LNG and natural gas in accordance with co-pending application Ser. No. 12/060,362 and U.S. Pat. No. 5,799,507, respectively, with the processed LNG stream used to provide refrigeration for the natural gas plant. The processes of FIG. 2 have been applied to the same LNG stream and inlet gas stream compositions and conditions as described previously for FIG. 1.

In the simulation of the FIG. 2 process, the LNG to be processed (stream 71) from LNG tank 50 enters pump 51 at −251° F. [−157° C.] to elevate the pressure of the LNG to 1364 psia [9,404 kPa(a)]. The high pressure LNG (stream 71*a*) then flows through heat exchanger 52 where it is heated from −242° F. [−152° C.] to −50° F. [−45° C.] (stream 71*b*) by heat exchange with compressed vapor stream 83*a* from booster compressor 56 and distillation vapor stream 73. The heated and vaporized stream 71*b* enters work expansion machine 55 in which mechanical energy is extracted as the vapor is expanded substantially isentropically to a pressure of about 455 psia [3,135 kPa(a)] (the operating pressure of fractionation column 62). The work expansion cools the expanded stream 71*c* to a temperature of approximately −122° F. [−86° C.], before it is supplied to fractionation column 62 at an upper mid-column feed point.

Expanded stream 71*c* enters fractionation column 62 in the lower region of the absorbing section of fractionation column 62. The liquid portion of stream 71*c* commingles with the liquids falling downward from the absorbing section and the combined liquid proceeds downward into the stripping section of deethanizer 62 (which includes reboiler 61). The vapor portion of expanded stream 71*c* rises upward through the absorbing section and is contacted with cold liquid falling downward to condense and absorb the $C_3$ components and heavier components.

A distillation liquid stream 72 is withdrawn from the lower region of the absorbing section in deethanizer 62 and is routed to heat exchanger 52. The distillation liquid stream is heated from −121° F. [−85° C.] to −50° F. [−45° C.], partially vaporizing stream 72*a* before it is returned as a lower mid-column feed to deethanizer 62, in the middle region of the stripping section.

A portion of the distillation vapor (stream 73) is withdrawn from the upper region of the stripping section of deethanizer 62 at −46° F. [−43° C.]. This stream is then cooled and partially condensed (stream 73*a*) in exchanger 52 by heat exchange with LNG stream 71*a* and distillation liquid stream 72 as described previously. The partially condensed stream 73*a* flows to reflux separator 64 at −104° F. [−76° C.]. The operating pressure of reflux separator 64 (452 psia [3,113 kPa(a)]) is slightly below the operating pressure of deethanizer 62 to provide the driving force which causes distillation vapor stream 73 to flow through heat exchanger 52 and into reflux separator 64, where the condensed liquid (stream 75) is separated from the uncondensed vapor (stream 74).

The liquid stream 75 from reflux separator 64 is pumped by pump 65 to a pressure slightly above the operating pressure of deethanizer 62, and the pumped stream 75*a* is then divided into two portions. One portion, stream 76, is supplied as top column feed (reflux) to deethanizer 62. This cold liquid reflux absorbs and condenses the $C_3$ components and heavier components rising in the upper rectification region of the absorbing section of deethanizer 62. The other portion, stream 77, is supplied to deethanizer 62 at a mid-column feed position located in the upper region of the stripping section in substantially the same region where distillation vapor stream 73 is withdrawn, to provide partial rectification of stream 73. The deethanizer overhead vapor (stream 79) exits the top of deethanizer 62 at −105° F. [−76° C.] and is combined with the uncondensed vapor (stream 74) to form cold vapor stream 83 at −105° F. [−76° C.]. The liquid product stream 80 exits the bottom of the tower at 174° F. [79° C.], based on a typical specification of an ethane to propane ratio of 0.020:1 on a molar basis in the bottom product.

Cold vapor stream 83 flows to compressor 56 driven by expansion machine 55 to increase the pressure of stream 83*a* sufficiently so that it can be totally condensed in heat exchanger 52. Stream 83*a* exits the compressor at −58° F. [−50° C.] and 669 psia [4,611 kPa(a)] and is cooled to −114° F. [−81° C.] (stream 83*b*) by heat exchange with the high pressure LNG feed stream 71*a* and distillation liquid stream 72 as discussed previously. Condensed stream 83*b* is pumped by pump 63 to a pressure slightly above the sales gas delivery pressure for subsequent vaporization in heat exchangers 23 and 12, heating stream 83*c* from −94° F. [−70° C.] to 40° F. [4° C.] as described in paragraphs [0033] and [0037] below to produce warm lean LNG stream 83*e*.

In the simulation of the FIG. 2 process, inlet gas enters the plant at 126° F. [52° C.] and 600 psia [4,137 kPa(a)] as stream 31. The feed stream 31 is cooled in heat exchanger 12 by heat exchange with cool lean LNG (stream 83*d*) at −56° F. [−49° C.], cool residue vapor stream 38, and separator liquids (stream 35*a*). The cooled stream 31*a* enters separator 13 at −51° F. [−46° C.] and 584 psia [4,027 kPa(a)] where the vapor (stream 34) is separated from the condensed liquid (stream 35).

The vapor from separator 13 (stream 34) enters a work expansion machine 10 in which mechanical energy is extracted from this portion of the high pressure feed. The machine 10 expands the vapor substantially isentropically to the operating pressure of fractionation tower 20 (approximately 441 psia [3,039 kPa(a)]), with the work expansion cooling the expanded stream 34*a* to a temperature of approximately −73° F. [−58° C.]. The partially condensed expanded stream 34*a* is then supplied as feed to fractionation tower 20 at an upper mid-column feed point. The liquid portion of stream 34*a* commingles with the liquids falling downward from the absorbing section and the combined liquid proceeds downward into the stripping section of deethanizer 20 (which includes reboiler 19). The vapor portion of expanded stream 34*a* rises upward through the absorbing section and is contacted with cold liquid falling downward to condense and absorb the $C_3$ components and heavier components.

Liquid stream 35 is flash expanded through an appropriate expansion device, such as expansion valve 17, to slightly above the operating pressure of fractionation tower 20. The expanded stream 35*a* leaving expansion valve 17 reaches a temperature of −62° F. [−52° C.] before it provides cooling to the incoming feed gas in heat exchanger 12 as described previously. The heated stream 35*b* at 82° F. [28° C.] then enters fractionation tower 20 at a lower mid-column feed point to be stripped of its methane and $C_2$ components.

A distillation liquid stream 36 is withdrawn from the lower region of the absorbing section in deethanizer 20 and is routed to heat exchanger 23. The distillation liquid stream is heated from −86° F. [−66° C.] to −12° F. [−24° C.], partially vaporizing stream 36*a* before it is returned as a lower mid-column feed to deethanizer 20, in the middle region of the stripping section.

A portion of the distillation vapor (stream 37) is withdrawn from the upper region of the stripping section of deethanizer 20 at −9° F. [−23° C.]. This stream is then cooled and partially condensed (stream 37*a*) in exchanger 23 by heat exchange with cold lean LNG stream 83*c* and with distillation liquid stream 36 as described previously. The partially condensed stream 37*a* flows to reflux separator 24 at −86° F. [−65° C.]. The operating pressure of reflux separator 24 (437 psia [3,012 kPa(a)]) is slightly below the operating pressure of deethanizer 20 to provide the driving force which causes distillation vapor stream 37 to flow through heat exchanger 23 and into reflux separator 24, where the condensed liquid (stream 45) is separated from the uncondensed vapor (stream 44).

The liquid stream 45 from reflux separator 24 is pumped by pump 25 to a pressure slightly above the operating pressure of deethanizer 20, and the pumped stream 45*a* is then divided into two portions. One portion, stream 46, is supplied as top column feed (reflux) to deethanizer 20. This cold liquid reflux absorbs and condenses the $C_3$ components and heavier components rising in the upper rectification region of the absorbing section of deethanizer 20. The other portion, stream 47, is supplied to deethanizer 20 at a mid-column feed position located in the upper region of the stripping section in substantially the same region where distillation vapor stream 37 is withdrawn, to provide partial rectification of stream 37.

The deethanizer overhead vapor (stream 43) exits the top of deethanizer 20 at −88° F. [−67° C.] and is directed into heat exchanger 23 to provide cooling to distillation vapor stream 36 as described previously. The heated overhead vapor stream 43*a* at −56° F. [−49° C.] is combined with the uncondensed vapor (stream 44) to form cool residue vapor stream 38 at −58° F. [−50° C.]. The liquid product stream 40 exits the bottom of the tower at 208° F. [98° C.], based on a typical specification of an ethane to propane ratio of 0.020:1 on a molar basis in the bottom product.

Cool residue vapor stream 38 passes countercurrently to inlet gas stream 31 in heat exchanger 12 where it is heated to 8° F. [−13° C.] (stream 38*a*). The heated residue vapor stream is then re-compressed in two stages. The first stage is compressor 11 driven by expansion machine 10. The second stage is compressor 21 driven by a supplemental power source which compresses stream 38*b* to sales line pressure (stream 38*c*). After cooling to 126° F. [52° C.] in discharge cooler 22, stream 38*d* combines with warm lean LNG stream 83*e* to form the residue gas product (stream 42). Residue gas stream 42 flows to the sales gas pipeline at 1262 psia [8,701 kPa(a)], sufficient to meet line requirements.

A summary of stream flow rates and energy consumption for the process illustrated in FIG. 2 is set forth in the following table:

TABLE II (FIG. 2)
Stream Flow Summary - Lb. Moles/Hr [kg moles/Hr]

| Stream | Methane | Ethane | Propane | Butanes+ | Total |
|---|---|---|---|---|---|
| 31 | 42,545 | 5,048 | 2,972 | 1,658 | 53,145 |
| 34 | 38,351 | 2,820 | 686 | 114 | 42,843 |
| 35 | 4,194 | 2,228 | 2,286 | 1,544 | 10,302 |
| 36 | 4,651 | 4,420 | 792 | 114 | 10,037 |
| 37 | 12,894 | 11,068 | 217 | 1 | 24,339 |
| 44 | 3,255 | 403 | 2 | 0 | 3,705 |
| 45 | 9,639 | 10,665 | 215 | 1 | 20,634 |
| 46 | 5,591 | 6,186 | 125 | 1 | 11,968 |
| 47 | 4,048 | 4,479 | 90 | 0 | 8,666 |
| 43 | 39,290 | 4,586 | 19 | 0 | 44,771 |
| 38 | 42,545 | 4,989 | 21 | 0 | 48,476 |
| 40 | 0 | 59 | 2,951 | 1,658 | 4,669 |
| 71 | 40,293 | 2,642 | 491 | 3 | 43,689 |
| 72 | 11,740 | 2,966 | 264 | 1 | 15,000 |
| 73 | 31,079 | 10,631 | 59 | 0 | 41,835 |
| 74 | 14,983 | 991 | 1 | 0 | 16,023 |
| 75 | 16,096 | 9,640 | 58 | 0 | 25,812 |
| 76 | 8,048 | 4,820 | 29 | 0 | 12,906 |
| 77 | 8,048 | 4,820 | 29 | 0 | 12,906 |
| 79 | 25,310 | 1,641 | 3 | 0 | 27,166 |
| 83 | 40,293 | 2,632 | 4 | 0 | 43,189 |
| 80 | 0 | 10 | 487 | 3 | 500 |
| 42 | 82,838 | 7,621 | 25 | 0 | 91,665 |
| 41 | 0 | 69 | 3,438 | 1,661 | 5,169 |

| Recoveries* | | |
|---|---|---|
| Propane | 99.29% | |
| Butanes+ | 100.00% | |
| **Power** | | |
| LNG Feed Pump | 3,552 HP | [5,839 kW] |
| LNG Product Pump | 2,766 HP | [4,547 kW] |
| Reflux Pump 25 | 80 HP | [132 kW] |
| Reflux Pump 63 | 96 HP | [158 kW] |
| Residue Gas Compressor | 22,801 HP | [37,485 kW] |
| Totals | 29,295 HP | [48,161 kW] |
| **High Level Utility Heat** | | |
| Deethanizer Reboiler 19 | 57,670 MBTU/Hr | [37,252 kW] |
| Deethanizer Reboiler 61 | 99,590 MBTU/Hr | [64,330 kW] |
| Totals | 157,260 MBTU/Hr | [101,582 kW] |
| **Specific Power** | | |
| HP-Hr/Lb. Mole | 5.667 | |
| [kW-Hr/kg mole] | | [9.317] |

*(Based on un-rounded flow rates)

Comparison of the recovery levels displayed in Tables I and II shows that the liquids recovery of the FIG. 2 processes is higher than that of the FIG. 1 process due to the recovery of the heavier hydrocarbon liquids contained in the LNG stream in fractionation tower 62. The propane recovery improves from 85.33% to 99.29% and the butanes+ recovery improves from 99.83% to 100.00%. The process efficiency of the FIG.

2 processes is slightly lower, however, about 4% in terms of the specific power relative to the FIG. 1 process.

DESCRIPTION OF THE INVENTION

Example 1

Figure 3:
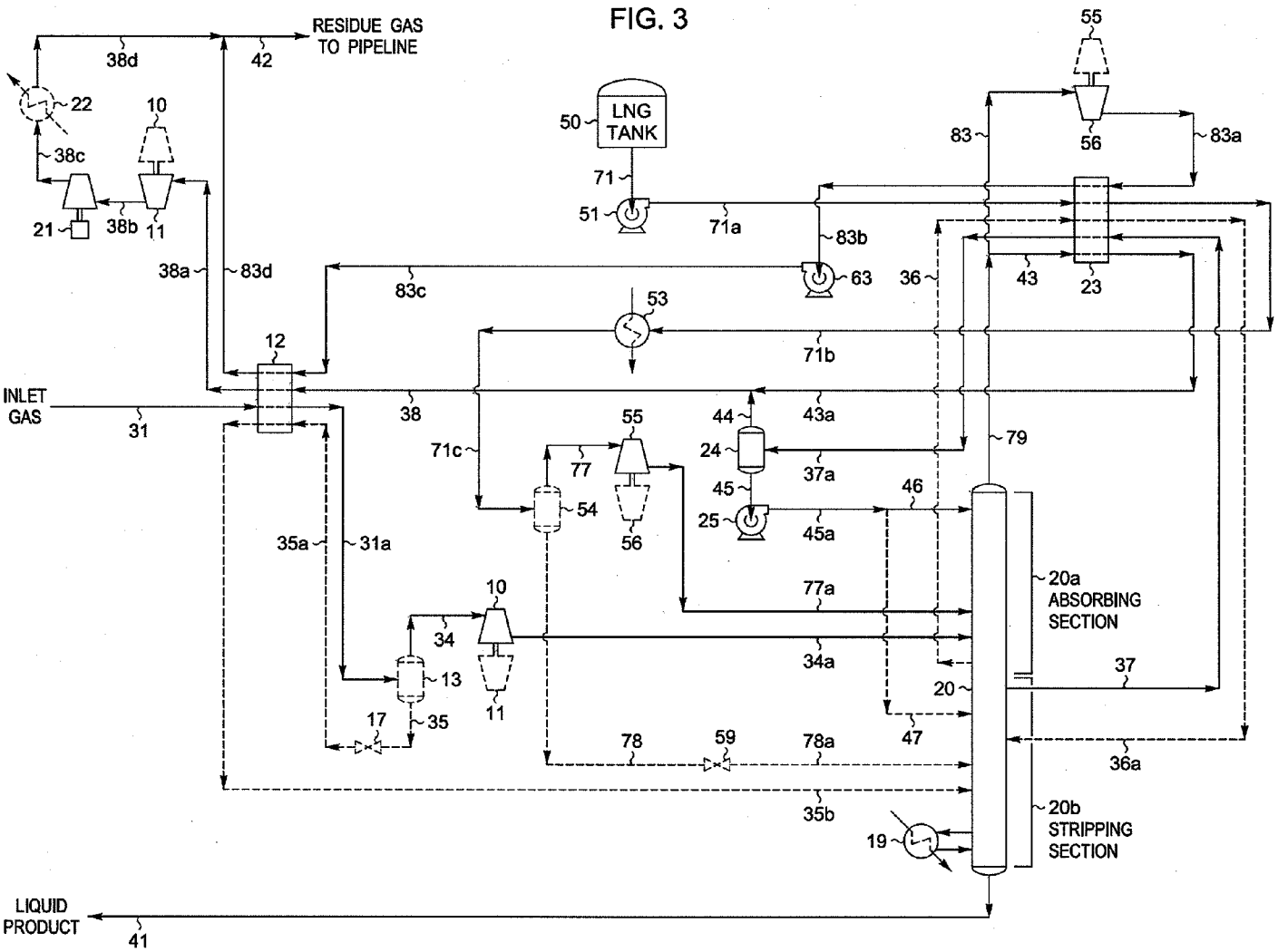
FIG. 3 is a flow diagram of an LNG and natural gas processing plant in accordance with the present invention.

FIG. 3 illustrates a flow diagram of a process in accordance with the present invention. The LNG stream and inlet gas stream compositions and conditions considered in the process presented in FIG. 3 are the same as those in the FIG. 1 and FIG. 2 processes. Accordingly, the FIG. 3 process can be compared with the FIG. 1 and FIG. 2 processes to illustrate the advantages of the present invention.

In the simulation of the FIG. 3 process, the LNG to be processed (stream 71) from LNG tank 50 enters pump 51 at −251° F. [−157° C.]. Pump 51 elevates the pressure of the LNG sufficiently so that it can flow through heat exchangers and thence to separator 54. Stream 71*a* exits the pump at −242° F. [−152° C.] and 1364 psia [9,404 kPa(a)] and is heated prior to entering separator 54 so that all or a portion of it is vaporized. In the example shown in FIG. 3, stream 71*a* is first heated to −24° F. [−31° C.] in heat exchanger 23 by cooling compressed second overhead vapor portion 83*a* (as further described in paragraph [0054]) at −42° F. [−41° C.] and distillation vapor stream 37. The partially heated stream 71*b* is further heated in heat exchanger 53 using low level utility heat. (High level utility heat, such as the heating medium used in tower reboiler 19, is normally more expensive than low level utility heat, so lower operating cost is usually achieved when use of low level heat, such as sea water, is maximized and the use of high level utility heat is minimized.) Note that in all cases exchangers 23 and 53 are representative of either a multitude of individual heat exchangers or a single multi-pass heat exchanger, or any combination thereof. (The decision as to whether to use more than one heat exchanger for the indicated heating services will depend on a number of factors including, but not limited to, inlet LNG flow rate, inlet gas flow rate, heat exchanger size, stream temperatures, etc.)

The heated stream 71*c* enters separator 54 at −12° F. [−24° C.] and 1339 psia [9,232 kPa(a)] where the vapor (stream 77) is separated from any remaining liquid (stream 78). Vapor stream 77 enters a work expansion machine 55 in which mechanical energy is extracted from the high pressure feed. The machine 55 expands the vapor substantially isentropically to the tower operating pressure (455 psia [3,135 kPa (a)]), with the work expansion cooling the expanded stream 77*a* to a temperature of approximately −105° F. [−76° C.]. The work recovered is often used to drive a centrifugal compressor (such as item 56) that can be used to re-compress the cold second overhead vapor portion (stream 83), for example. The partially condensed expanded stream 77*a* is thereafter supplied as feed to fractionation column 20 at a first mid-column feed point. The separator liquid (stream 78), if any, is expanded to the operating pressure of fractionation column 20 by expansion valve 59 before expanded stream 78*a* is supplied to fractionation tower 20 at a first lower mid-column feed point.

In the simulation of the FIG. 3 process, inlet gas enters the plant at 126° F. [52° C.] and 600 psia [4,137 kPa(a)] as stream 31. The feed stream 31 is cooled in heat exchanger 12 by heat exchange with cool lean LNG (stream 83*c*) at −90° F. [−68° C.], cool residue vapor stream 38 at −52° F. [−47° C.], and separator liquids (stream 35*a*). Note that in all cases exchanger 12 is representative of either a multitude of individual heat exchangers or a single multi-pass heat exchanger, or any combination thereof. (The decision as to whether to use more than one heat exchanger for the indicated cooling service will depend on a number of factors including, but not limited to, inlet LNG flow rate, inlet gas flow rate, heat exchanger size, stream temperatures, etc.) The cooled stream 31*a* enters separator 13 at −74° F. [−59° C.] and 584 psia [4,027 kPa(a)] where the vapor (stream 34) is separated from the condensed liquid (stream 35).

The vapor from separator 13, stream 34, enters a work expansion machine 10 in which mechanical energy is extracted from this portion of the high pressure feed. The machine 10 expands the vapor substantially isentropically to the operating pressure of fractionation tower 20, with the work expansion cooling the expanded stream 34*a* to a temperature of approximately −93° F. [−70° C.]. The work recovered is often used to drive a centrifugal compressor (such as item 11) that can be used to re-compress the heated residue vapor stream (stream 38*a*), for example. The partially condensed expanded stream 34*a* is then supplied to fractionation tower 20 at a second mid-column feed point.

Liquid stream 35 is flash expanded through an appropriate expansion device, such as expansion valve 17, to slightly above the operating pressure of fractionation tower 20. The expanded stream 35*a* leaving expansion valve 17 reaches a temperature of −85° F. [−65° C.] before it provides cooling to the incoming feed gas in heat exchanger 12 as described previously. The heated stream 35*b* at 81° F. [27° C.] then enters fractionation tower 20 at a second lower mid-column feed point to be stripped of its methane and $C_2$ components.

The deethanizer in fractionation column 20 is a conventional distillation column containing a plurality of vertically spaced trays, one or more packed beds, or some combination of trays and packing. The fractionation tower 20 may consist of two sections. The upper absorbing (rectification) section 20*a* contains the trays and/or packing to provide the necessary contact between the vapors rising upward and cold liquid falling downward to condense and absorb the $C_3$ components and heavier components; the lower stripping (deethanizing) section 20*b* contains the trays and/or packing to provide the necessary contact between the liquids falling downward and the vapors rising upward. The deethanizing section also includes one or more reboilers (such as reboiler 19 using high level utility heat) which heat and vaporize a portion of the liquids flowing down the column to provide the stripping vapors which flow up the column. The column liquid stream 41 exits the bottom of the tower at 208° F. [98° C.], based on a typical specification of an ethane to propane ratio of 0.020:1 on a molar basis in the bottom product.

The partially condensed expanded streams 77*a* and 34*a* are supplied to fractionation tower 20 in the lower region of absorbing section 20*a*. The liquid portions of streams 77*a* and 34*a* commingle with the liquids falling downward from absorbing section 20*a* and the combined liquid proceeds downward into stripping section 20*b* of deethanizer 20. The vapor portions of expanded streams 77*a* and 34*a* rise upward through absorbing section 20*a* and are contacted with cold liquid falling downward to condense and absorb the $C_3$ components and heavier components.

A distillation liquid stream 36 is withdrawn from the lower region of absorbing section 20*a* in deethanizer 20 and is routed to heat exchanger 23. The distillation liquid stream is heated from −106° F. [−77° C.] to −24° F. [−31° C.], partially vaporizing stream 36*a* before it is returned to deethanizer 20 at a third lower mid-column feed position in the middle region of stripping section 20*b*.

A portion of the distillation vapor (stream 37) is withdrawn from the upper region of stripping section 20*b* in deethanizer 20 at −21° F. [−29° C.]. This stream is then cooled and partially condensed (stream 37*a*) in exchanger 23 by heat exchange with cold LNG stream 71*a* and distillation liquid stream 36 as described previously, and with cold first overhead vapor portion 43. The partially condensed stream 37*a* flows to reflux separator 24 at −87° F. [−66° C.]. The operating pressure of reflux separator 24 (452 psia [3,113 kPa(a)]) is slightly below the operating pressure of deethanizer 20 to provide the driving force which causes distillation vapor stream 37 to flow through heat exchanger 23 and into reflux separator 24, where the condensed liquid (stream 45) is separated from the uncondensed vapor (stream 44).

The liquid stream 45 from reflux separator 24 is pumped by pump 25 to a pressure slightly above the operating pressure of deethanizer 20, and the pumped stream 45*a* is then divided into two portions. One portion, stream 46, is supplied as top column feed (reflux) to deethanizer 20. This cold liquid reflux absorbs and condenses the $C_3$ components and heavier components rising in the upper rectification region of absorbing section 20*a* of deethanizer 20. The other portion, stream 47, is supplied to deethanizer 20 at a mid-column feed position located in the upper region of stripping section 20*b* in substantially the same region where distillation vapor stream 37 is withdrawn, to provide partial rectification of stream 37.

The deethanizer overhead vapor (stream 79) exits the top of deethanizer 20 at −97° F. [−71° C.] and is divided into two portions, first overhead vapor portion 43 and second overhead vapor portion 83. First overhead vapor portion 43 is directed into heat exchanger 23 to provide cooling to distillation vapor stream 37 as described previously. The heated first overhead vapor portion 43*a* at −24° F. [−31° C.] is combined with any uncondensed vapor (stream 44) to form cool residue vapor stream 38, which passes countercurrently to inlet gas stream 31 in heat exchanger 12 where it is heated to −24° F. [−31° C.] (stream 38*a*). The residue vapor stream is then re-compressed in two stages. The first stage is compressor 11 driven by expansion machine 10. The second stage is compressor 21 driven by a supplemental power source which compresses stream 38*b* to sales line pressure (stream 38*c*). (Note that discharge cooler 22 is not needed in this example. Some applications may require cooling of compressed residue vapor stream 38*c* so that the resultant temperature when mixed with warm lean LNG stream 83*d* is sufficiently cool to comply with the requirements of the sales gas pipeline.)

Second overhead vapor portion 83 flows to compressor 56 driven by expansion machine 55, where it is compressed to 701 psia [4,833 kPa(a)] (stream 83*a*). At this pressure, the stream is totally condensed as it is cooled to −109° F. [−78° C.] in heat exchanger 23 as described previously. The condensed liquid (stream 83*b*) is the methane-rich lean LNG stream, which is pumped by pump 63 to 1275 psia [8,791 kPa(a)] for vaporization in heat exchanger 12, heating stream 83*c* to −25° F. [−32° C.] as described previously to produce warm lean LNG stream 83*d* which then combines with compressed residue vapor stream 38*c*/38*d* to form the residue gas product (stream 42). Residue gas stream 42 flows to the sales gas pipeline at 30° F. [−1° C.] and 1262 psia [8,701 kPa(a)], sufficient to meet line requirements.

A summary of stream flow rates and energy consumption for the process illustrated in FIG. 3 is set forth in the following table:

TABLE III (FIG. 3)
Stream Flow Summary - Lb. Moles/Hr [kg moles/Hr]

| Stream | Methane | Ethane | Propane | Butanes+ | Total |
|---|---|---|---|---|---|
| 31 | 42,545 | 5,048 | 2,972 | 1,658 | 53,145 |
| 34 | 34,773 | 1,835 | 337 | 49 | 37,824 |
| 35 | 7,772 | 3,213 | 2,635 | 1,609 | 15,321 |
| 71 | 40,293 | 2,642 | 491 | 3 | 43,689 |
| 77 | 40,293 | 2,642 | 491 | 3 | 43,689 |
| 78 | 0 | 0 | 0 | 0 | 0 |
| 36 | 16,096 | 8,441 | 940 | 51 | 25,636 |
| 37 | 31,988 | 19,726 | 240 | 0 | 52,217 |
| 44 | 13,917 | 1,624 | 4 | 0 | 15,662 |
| 45 | 18,071 | 18,102 | 236 | 0 | 36,555 |
| 46 | 9,939 | 9,956 | 130 | 0 | 20,105 |
| 47 | 8,132 | 8,146 | 106 | 0 | 16,450 |
| 79 | 68,921 | 5,997 | 17 | 0 | 75,999 |
| 43 | 19,983 | 1,738 | 5 | 0 | 22,035 |
| 38 | 33,900 | 3,362 | 9 | 0 | 37,697 |
| 83 | 48,938 | 4,259 | 12 | 0 | 53,964 |
| 42 | 82,838 | 7,621 | 21 | 0 | 91,661 |
| 41 | 0 | 69 | 3,442 | 1,661 | 5,173 |

| Recoveries* | | |
|---|---|---|
| Propane | 99.41% | |
| Butanes+ | 100.00% | |
| **Power** | | |
| LNG Feed Pump | 3,552 HP | [5,839 kW] |
| LNG Product Pump | 3,332 HP | [5,478 kW] |
| Reflux Pump | 140 HP | [230 kW] |
| Residue Gas Compressor | 15,029 HP | [24,708 kW] |
| Totals | 22,053 HP | [36,255 kW] |
| **Low Level Utility Heat** | | |
| Liquid Feed Heater | 11,000 MBTU/Hr | [7,105 kW] |
| **High Level Utility Heat** | | |
| Deethanizer Reboiler | 74,410 MBTU/Hr | [48,065 kW] |
| **Specific Power** | | |
| HP-Hr/Lb. Mole | 4.263 | |
| [kW-Hr/kg mole] | | [7.009] |

*(Based on un-rounded flow rates)

The improvement offered by the FIG. 3 embodiment of the present invention is astonishing compared to the FIG. 1 and FIG. 2 processes. Comparing the recovery levels displayed in Table III above for the FIG. 3 embodiment with those in Table I for the FIG. 1 process shows that the FIG. 3 embodiment of the present invention improves the propane recovery from 85.33% to 99.41% and the butanes+ recovery from 99.83% to 100.00%. Further, comparing the utilities consumptions in Table III with those in Table I shows that the process efficiency of the FIG. 3 embodiment of the present invention is significantly better than that of the FIG. 1 process, achieving the higher recovery level using approximately 13% less power. The gain in process efficiency is clearly seen in the drop in the specific power, from 5.427 HP-Hr/Lb. Mole [8.922 kW-Hr/kg mole] for the FIG. 1 process to 4.263 HP-Hr/Lb. Mole [7.009 kW-Hr/kg mole] for the FIG. 3 embodiment of the present invention, an increase of more than 21% in the production efficiency.

Comparing the recovery levels displayed in Table III for the FIG. 3 embodiment with those in Table II for the FIG. 2 processes shows that the liquids recovery levels are essentially the same. However, comparing the utilities consumptions in Table III with those in Table II shows that the power required for the FIG. 3 embodiment of the present invention is about 25% lower than the FIG. 2 processes. This results in reducing the specific power from 5.667 HP-Hr/Lb. Mole [9.317 kW-Hr/kg mole] for the FIG. 2 processes to 4.263 HP-Hr/Lb. Mole [7.009 kW-Hr/kg mole] for the FIG. 3 embodiment of the present invention, an improvement of nearly 25% in the production efficiency.

There are six primary factors that account for the improved efficiency of the present invention. First, compared to many prior art processes, the present invention does not depend on the LNG feed itself to directly serve as the reflux for fractionation column 20. Rather, the refrigeration inherent in the cold LNG is used in heat exchanger 23 to generate a liquid reflux stream (stream 46) that contains very little of the $C_3$ components and heavier hydrocarbon components that are to be recovered, resulting in efficient rectification in absorbing section 20*a* of fractionation tower 20 and avoiding the equilibrium limitations of such prior art processes. Second, the partial rectification of distillation vapor stream 37 by reflux stream 47 results in a top reflux stream 46 that is predominantly liquid methane and $C_2$ components and contains very little $C_3$ components and heavier hydrocarbon components. As a result, nearly 100% of the $C_3$ components and substantially all of the heavier hydrocarbon components are recovered in liquid product 41 leaving the bottom of deethanizer 20. Third, the rectification of the column vapors provided by absorbing section 20*a* allows all of the LNG feed to be vaporized before entering work expansion machine 55 as stream 77, resulting in significant power recovery. This power can then be used to compress second overhead vapor portion 83 to a pressure sufficiently high so that it can be condensed in heat exchanger 23 and thereafter pumped to the pipeline delivery pressure. (Pumping uses significantly less power than compressing.)

Fourth, vaporization of the LNG feed (with part of the vaporization duty provided by low level utility heat in heat exchanger 53) means less total liquid feeding fractionation column 20, so that the high level utility heat consumed by reboiler 19 to meet the specification for the bottom liquid product from the deethanizer is minimized. Fifth, using the cold lean LNG stream 83*c* to provide "free" refrigeration to inlet gas stream 31 in heat exchanger 12 eliminates the need for a separate vaporization means (such as heat exchanger 53 in the FIG. 1 process) to re-vaporize the LNG prior to delivery to the sales gas pipeline. Sixth, this "free" refrigeration of inlet gas stream 31 means less of the cooling duty in heat exchanger 12 must be supplied by residue vapor stream 38, so that stream 38*a* is cooler and less compression power is needed to raise its pressure to the pipeline delivery condition.

Example 2

Figure 4:
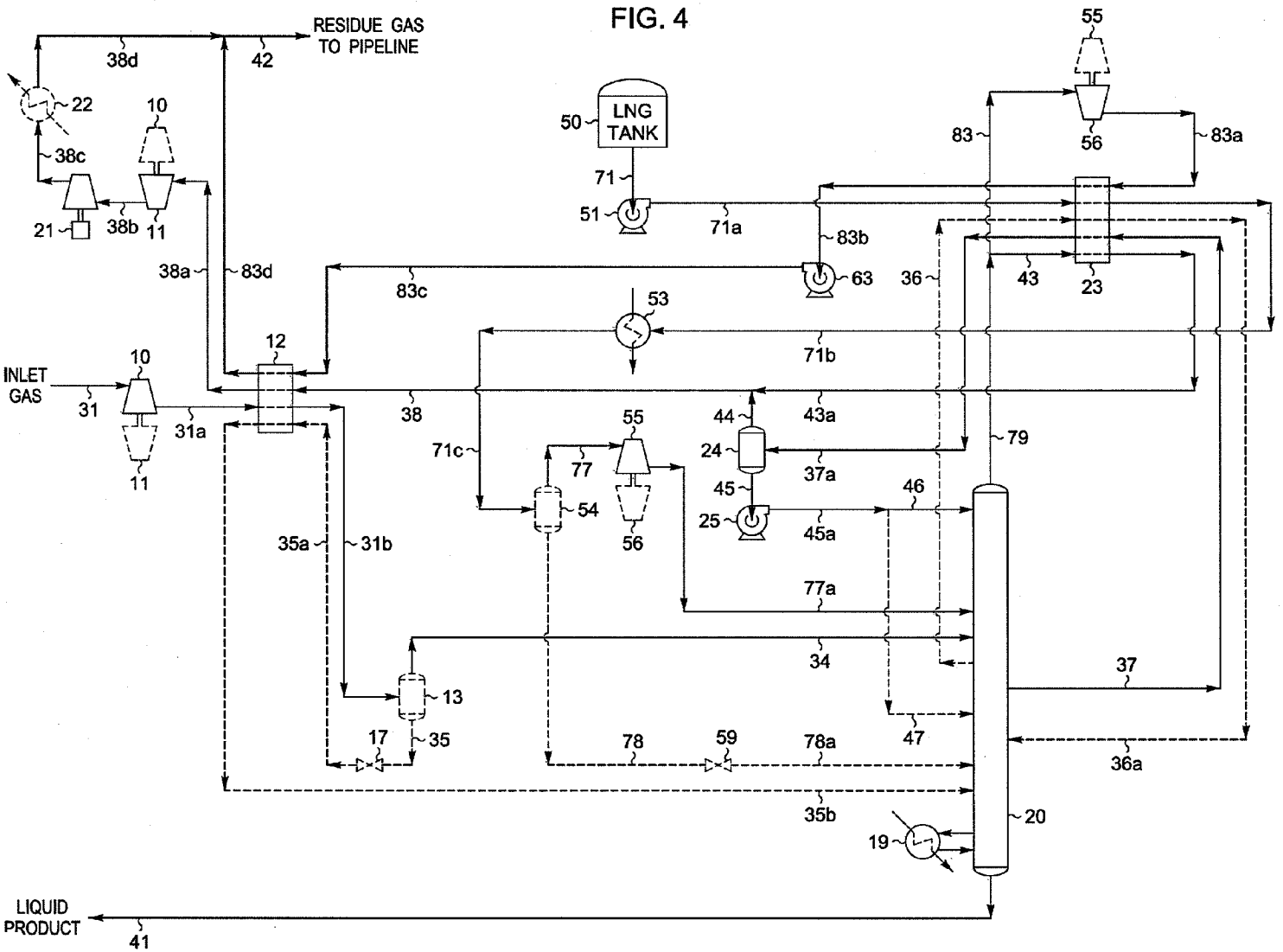
FIGS. 4 through 8 are flow diagrams illustrating alternative means of application of the present invention to LNG and natural gas streams.

An alternative method of processing LNG and natural gas is shown in another embodiment of the present invention as illustrated in FIG. 4. The LNG stream and inlet gas stream compositions and conditions considered in the process presented in FIG. 4 are the same as those in FIGS. 1 through 3. Accordingly, the FIG. 4 process can be compared with the FIGS. 1 and 2 processes to illustrate the advantages of the present invention, and can likewise be compared to the embodiment displayed in FIG. 3.

In the simulation of the FIG. 4 process, the LNG to be processed (stream 71) from LNG tank 50 enters pump 51 at −251° F. [−157° C.]. Pump 51 elevates the pressure of the LNG sufficiently so that it can flow through heat exchangers and thence to separator 54. Stream 71*a* exits the pump at −242° F. [−152° C.] and 1364 psia [9,404 kPa(a)] and is heated to −17° F. [−27° C.] in heat exchanger 23 by cooling compressed second overhead vapor portion 83*a* at −44° F. [−42° C.] and distillation vapor stream 37. The partially heated stream 71*b* is further heated in heat exchanger 53 using low level utility heat, and enters separator 54 at −11° F. [−24° C.] and 1339 psia [9,232 kPa(a)] where the vapor (stream 77) is separated from any remaining liquid (stream 78).

Vapor stream 77 enters a work expansion machine 55 in which mechanical energy is extracted from the high pressure feed. The machine 55 expands the vapor substantially isentropically to the tower operating pressure (455 psia [3,135 kPa(a)]), with the work expansion cooling the expanded stream 77*a* to a temperature of approximately −105° F. [−76° C.]. The partially condensed expanded stream 77*a* is thereafter supplied as feed to fractionation column 20 at a first mid-column feed point. The separator liquid (stream 78), if any, is expanded to the operating pressure of fractionation column 20 by expansion valve 59 before expanded stream 78*a* is supplied to fractionation tower 20 at a first lower mid-column feed point.

In the simulation of the FIG. 4 process, inlet gas enters the plant at 126° F. [52° C.] and 600 psia [4,137 kPa(a)] as stream 31 and flows to a work expansion machine 10 in which mechanical energy is extracted from the high pressure feed. The machine 10 expands the vapor substantially isentropically to slightly above the tower operating pressure, with the work expansion cooling the expanded stream 31*a* to a temperature of approximately 100° F. [38° C.]. The expanded stream 31*a* is further cooled in heat exchanger 12 by heat exchange with cool lean LNG (stream 83*c*) at −96° F. [−71° C.], cool residue vapor stream 38 at −35° F. [−37° C.], and separator liquids (stream 35*a*).

The further cooled stream 31*b* enters separator 13 at −76° F. [−60° C.] and 458 psia [3,156 kPa(a)] where the vapor (stream 34) is separated from the condensed liquid (stream 35) and thereafter supplied to fractionation tower 20 at a second mid-column feed point. Liquid stream 35 is directed through valve 17 and then to heat exchanger 12 where it provides cooling to the incoming feed gas as described previously. The heated stream 35*b* at 65° F. [18° C.] then enters fractionation tower 20 at a second lower mid-column feed point to be stripped of its methane and $C_2$ components.

A distillation liquid stream 36 is withdrawn from the lower region of the absorbing section in deethanizer 20 and is routed to heat exchanger 23. The distillation liquid stream is heated from −100° F. [−73° C.] to −17° F. [−27° C.], partially vaporizing stream 36*a* before it is returned to deethanizer 20 at a third lower mid-column feed position in the middle region of the stripping section.

A portion of the distillation vapor (stream 37) is withdrawn from the upper region of the stripping section in deethanizer 20 at −14° F. [−26° C.]. This stream is then cooled and partially condensed (stream 37*a*) in exchanger 23 by heat exchange with cold LNG stream 71*a* and distillation liquid stream 36 as described previously, and with cold first overhead vapor portion 43. The partially condensed stream 37*a* flows to reflux separator 24 at −84° F. [−64° C.] and 452 psia [3,113 kPa(a)] where the condensed liquid (stream 45) is separated from the uncondensed vapor (stream 44).

The liquid stream 45 from reflux separator 24 is pumped by pump 25 to a pressure slightly above the operating pressure of deethanizer 20, and the pumped stream 45*a* is then divided into two portions. One portion, stream 46, is supplied as top column feed (reflux) to deethanizer 20. The other portion, stream 47, is supplied to deethanizer 20 at a mid-column feed position located in the upper region of the stripping section in substantially the same region where distillation vapor stream 37 is withdrawn.

The column liquid stream 41 exits the bottom of the tower at 208° F. [98° C.], based on a typical specification of an ethane to propane ratio of 0.020:1 on a molar basis in the bottom product. The deethanizer overhead vapor (stream 79) exits the top of deethanizer 20 at −96° F. [−71° C.] and is divided into two portions, first overhead vapor portion 43 and second overhead vapor portion 83. First overhead vapor portion 43 is directed into heat exchanger 23 to provide cooling to distillation vapor stream 37 as described previously. The heated first overhead vapor portion 43*a* at −17° F. [−27° C.] is combined with any uncondensed vapor (stream 44) to form cool residue vapor stream 38, which passes countercurrently to expanded inlet gas stream 31 in heat exchanger 12 where it is heated to −26° F. [−32° C.] (stream 38*a*). The residue vapor stream is then re-compressed in two stages. The first stage is compressor 11 driven by expansion machine 10. The second stage is compressor 21 driven by a supplemental power source which compresses stream 38*b* to sales line pressure (stream 38*c*).

Second overhead vapor portion 83 flows to compressor 56 driven by expansion machine 55, where it is compressed to 686 psia [4,729 kPa(a)] (stream 83*a*). At this pressure, the stream is totally condensed as it is cooled to 113° [−81° C.]. in heat exchanger 23 as described previously. The condensed liquid (stream 83*b*) is the methane-rich lean LNG stream, which is pumped by pump 63 to 1275 psia [8,791 kPa(a)] for vaporization in heat exchanger 12, heating stream 83*c* to −27° F. [−33° C.] as described previously to produce warm lean LNG stream 83*d* which then combines with compressed residue vapor stream 38*c*/38*d* to form the residue gas product (stream 42). Residue gas stream 42 flows to the sales gas pipeline at 23° F. [−5° C.] and 1262 psia [8,701 kPa(a)], sufficient to meet line requirements.

A summary of stream flow rates and energy consumption for the process illustrated in FIG. 4 is set forth in the following table:

TABLE IV (FIG. 4)
Stream Flow Summary - Lb. Moles/Hr [kg moles/Hr]

| Stream | Methane | Ethane | Propane | Butanes+ | Total |
|---|---|---|---|---|---|
| 31 | 42,545 | 5,048 | 2,972 | 1,658 | 53,145 |
| 34 | 37,653 | 2,196 | 375 | 47 | 41,134 |
| 35 | 4,892 | 2,852 | 2,597 | 1,611 | 12,011 |
| 71 | 40,293 | 2,642 | 491 | 3 | 43,689 |
| 77 | 40,293 | 2,642 | 491 | 3 | 43,689 |
| 78 | 0 | 0 | 0 | 0 | 0 |
| 36 | 10,106 | 6,262 | 949 | 50 | 17,438 |
| 37 | 21,424 | 15,946 | 193 | 0 | 37,746 |
| 44 | 7,479 | 951 | 3 | 0 | 8,495 |
| 45 | 13,945 | 14,995 | 190 | 0 | 29,251 |
| 46 | 7,530 | 8,097 | 103 | 0 | 15,796 |
| 47 | 6,415 | 6,898 | 87 | 0 | 13,455 |
| 79 | 75,359 | 6,670 | 18 | 0 | 83,167 |
| 43 | 23,742 | 2,102 | 6 | 0 | 26,202 |
| 38 | 31,221 | 3,053 | 9 | 0 | 34,697 |
| 83 | 51,617 | 4,568 | 12 | 0 | 56,965 |
| 42 | 82,838 | 7,621 | 21 | 0 | 91,662 |
| 41 | 0 | 69 | 3,442 | 1,661 | 5,172 |

| Recoveries* | | |
|---|---|---|
| Propane | 99.38% | |
| Butanes+ | 100.00% | |
| **Power** | | |
| LNG Feed Pump | 3,552 HP | [5,839 kW] |
| LNG Product Pump | 3,411 HP | [5,608 kW] |
| Reflux Pump | 113 HP | [186 kW] |
| Residue Gas Compressor | 11,336 HP | [18,636 kW] |
| Totals | 18,412 HP | [30,269 kW] |
| **Low Level Utility Heat** | | |
| Liquid Feed Heater | 5,400 MBTU/Hr | [3,488 kW] |
| **High Level Utility Heat** | | |
| Deethanizer Reboiler | 80,800 MBTU/Hr | [52,193 kW] |
| **Specific Power** | | |
| HP-Hr/Lb. Mole | 3.560 | |
| [kW-Hr/kg mole] | | [5.852] |

*(Based on un-rounded flow rates)

A comparison of Tables III and IV shows that the FIG. 4 embodiment of the present invention achieves essentially the same liquids recovery as the FIG. 3 embodiment. However, the FIG. 4 embodiment uses less power than the FIG. 3 embodiment, improving the specific power by more than 16%. However, the high level utility heat required for the FIG. 4 embodiment of the present invention is somewhat higher (by less than 9%) than that required for the FIG. 3 embodiment of the present invention.

Example 3

Figure 5:
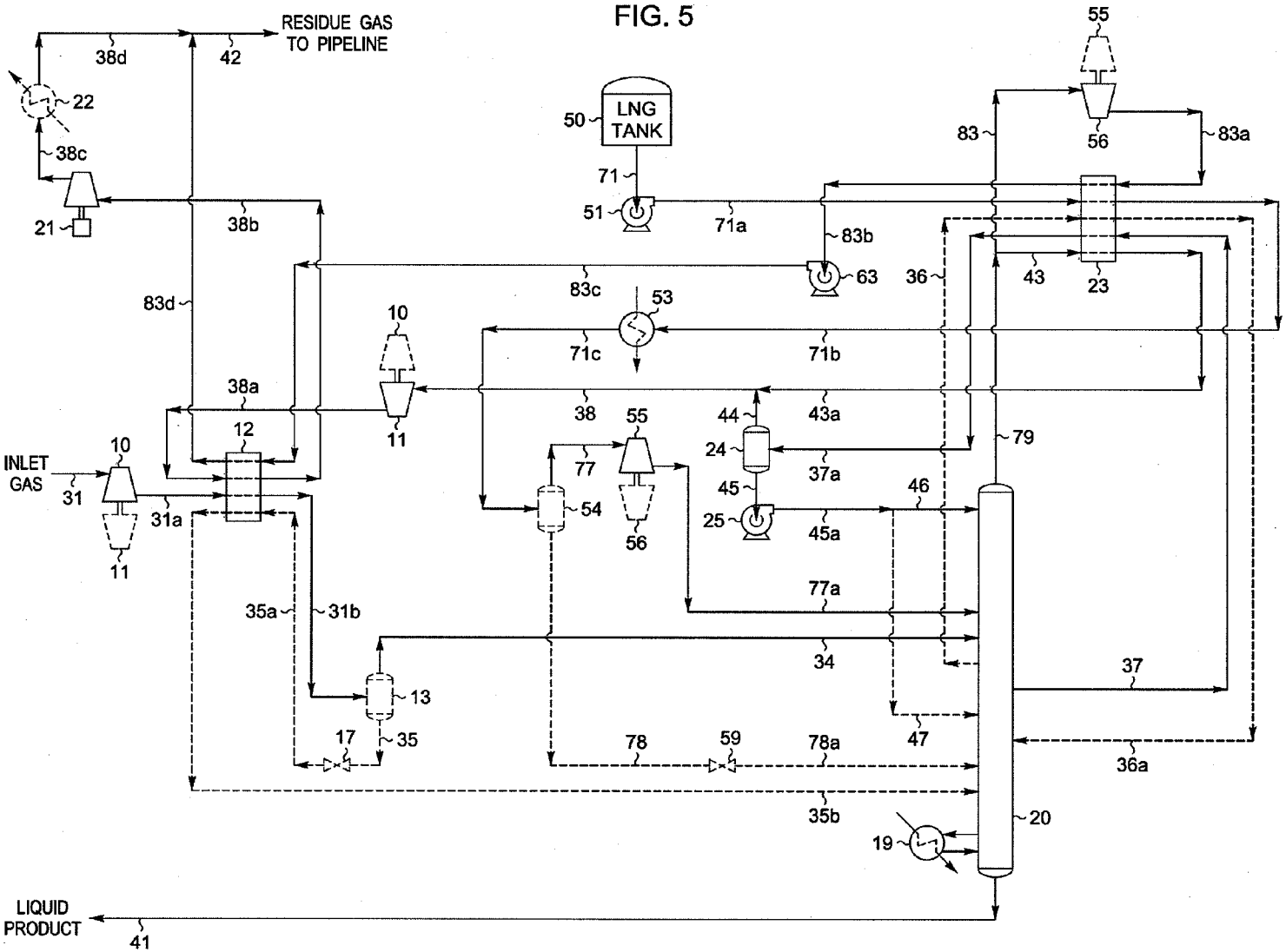

Another alternative method of processing LNG and natural gas is shown in the embodiment of the present invention as illustrated in FIG. 5. The LNG stream and inlet gas stream compositions and conditions considered in the process presented in FIG. 5 are the same as those in FIGS. 1 through 4. Accordingly, the FIG. 5 process can be compared with the FIGS. 1 and 2 processes to illustrate the advantages of the present invention, and can likewise be compared to the embodiments displayed in FIGS. 3 and 4.

In the simulation of the FIG. 5 process, the LNG to be processed (stream 71) from LNG tank 50 enters pump 51 at −251° F. [−157° C.]. Pump 51 elevates the pressure of the LNG sufficiently so that it can flow through heat exchangers and thence to separator 54. Stream 71*a* exits the pump at −242° F. [−152° C.] and 1364 psia [9,404 kPa(a)] and is heated to −16° F. [−27° C.] in heat exchanger 23 by cooling compressed second overhead vapor portion 83*a* at −42° F. [−41° C.] and distillation vapor stream 37. The partially heated stream 71*b* is further heated in heat exchanger 53 using low level utility heat, and enters separator 54 at −4° F. [−20° C.] and 1339 psia [9,232 kPa(a)] where the vapor (stream 77) is separated from any remaining liquid (stream 78).

Vapor stream 77 enters a work expansion machine 55 in which mechanical energy is extracted from the high pressure feed. The machine 55 expands the vapor substantially isentropically to the tower operating pressure (455 psia [3,135 kPa(a)]), with the work expansion cooling the expanded stream 77*a* to a temperature of approximately −101° F. [−74° C.]. The partially condensed expanded stream 77*a* is thereafter supplied as feed to fractionation column 20 at a first mid-column feed point. The separator liquid (stream 78), if any, is expanded to the operating pressure of fractionation column 20 by expansion valve 59 before expanded stream 78*a* is supplied to fractionation tower 20 at a first lower mid-column feed point.

In the simulation of the FIG. 5 process, inlet gas enters the plant at 126° F. [52° C.] and 600 psia [4,137 kPa(a)] as stream 31 and flows to a work expansion machine 10 in which mechanical energy is extracted from the high pressure feed. The machine 10 expands the vapor substantially isentropically to slightly above the tower operating pressure, with the work expansion cooling the expanded stream 31*a* to a temperature of approximately 100° F. [38° C.]. The expanded stream 31*a* is further cooled in heat exchanger 12 by heat exchange with cool lean LNG (stream 83*c*) at −90° F. [−68° C.] and separator liquids (stream 35*a*).

The further cooled stream 31*b* enters separator 13 at −72° F. [−58° C.] and 458 psia [3,156 kPa(a)] where the vapor (stream 34) is separated from the condensed liquid (stream 35) and thereafter supplied to fractionation tower 20 at a second mid-column feed point. Liquid stream 35 is directed through valve 17 and then to heat exchanger 12 where it provides cooling to the incoming feed gas as described previously. The heated stream 35*b* at 66° F. [19° C.] then enters fractionation tower 20 at a second lower mid-column feed point to be stripped of its methane and $C_2$ components.

A distillation liquid stream 36 is withdrawn from the lower region of the absorbing section in deethanizer 20 and is routed to heat exchanger 23. The distillation liquid stream is heated from −96° F. [−71° C.] to −16° F. [−27° C.], partially vaporizing stream 36*a* before it is returned to deethanizer 20 at a third lower mid-column feed position in the middle region of the stripping section.

A portion of the distillation vapor (stream 37) is withdrawn from the upper region of the stripping section in deethanizer 20 at −13° F. [−25° C.]. This stream is then cooled and partially condensed (stream 37*a*) in exchanger 23 by heat exchange with cold LNG stream 71*a* and distillation liquid stream 36 as described previously, and with cold first overhead vapor portion 43. The partially condensed stream 37*a* flows to reflux separator 24 at −87° F. [−66° C.] and 452 psia [3,113 kPa(a)] where the condensed liquid (stream 45) is separated from the uncondensed vapor (stream 44).

The liquid stream 45 from reflux separator 24 is pumped by pump 25 to a pressure slightly above the operating pressure of deethanizer 20, and the pumped stream 45*a* is then divided into two portions. One portion, stream 46, is supplied as top column feed (reflux) to deethanizer 20. The other portion, stream 47, is supplied to deethanizer 20 at a mid-column feed position located in the upper region of the stripping section in substantially the same region where distillation vapor stream 37 is withdrawn.

The column liquid stream 41 exits the bottom of the tower at 208° F. [98° C.], based on a typical specification of an ethane to propane ratio of 0.020:1 on a molar basis in the bottom product. The deethanizer overhead vapor (stream 79) exits the top of deethanizer 20 at −95° F. [−71° C.] and is divided into two portions, first overhead vapor portion 43 and second overhead vapor portion 83. First overhead vapor portion 43 is directed into heat exchanger 23 to provide cooling to distillation vapor stream 37 as described previously. The heated first overhead vapor portion 43*a* at −16° F. [−27° C.] is combined with any uncondensed vapor (stream 44) to form cool residue vapor stream 38 at −30° F. [−34° C.], which is partially re-compressed by compressor 11 driven by expansion machine 10. Because of the efficiency of the FIG. 5 embodiment of the present invention, compressed residue vapor stream 38*a* does not need to provide any cooling to expanded inlet gas stream 31*a*. Instead, compressed residue vapor stream 38*a* passes countercurrently to cool lean LNG (stream 83*c*) and separator liquids (stream 35*a*) in heat exchanger 12 as described previously to be cooled, so that less power is needed to compress the stream. Cooled residue vapor stream 38*b* at −11° F. [−24° C.] then enters compressor 21 driven by a supplemental power source which compresses stream 38*b* to sales line pressure (stream 38*c*).

Second overhead vapor portion 83 flows to compressor 56 driven by expansion machine 55, where it is compressed to 693 psia [4,781 kPa(a)] (stream 83*a*). At this pressure, the stream is totally condensed as it is cooled to −109° F. [−78° C.] in heat exchanger 23 as described previously. The condensed liquid (stream 83*b*) is the methane-rich lean LNG stream, which is pumped by pump 63 to 1275 psia [8,791 kPa(a)] for vaporization in heat exchanger 12, heating stream 83*c* to −11° F. [−24° C.] as described previously to produce warm lean LNG stream 83*d* which then combines with compressed residue vapor stream 38*c*/38*d* to form the residue gas product (stream 42). Residue gas stream 42 flows to the sales gas pipeline at 23° F. [−5° C.] and 1262 psia [8,701 kPa(a)], sufficient to meet line requirements.

A summary of stream flow rates and energy consumption for the process illustrated in FIG. 5 is set forth in the following table:

TABLE V (FIG. 5)
Stream Flow Summary - Lb. Moles/Hr [kg moles/Hr]

| Stream | Methane | Ethane | Propane | Butanes+ | Total |
|---|---|---|---|---|---|
| 31 | 42,545 | 5,048 | 2,972 | 1,658 | 53,145 |
| 34 | 38,147 | 2,374 | 430 | 56 | 41,875 |
| 35 | 4,398 | 2,674 | 2,542 | 1,602 | 11,270 |
| 71 | 40,293 | 2,642 | 491 | 3 | 43,689 |
| 77 | 40,293 | 2,642 | 491 | 3 | 43,689 |
| 78 | 0 | 0 | 0 | 0 | 0 |
| 36 | 8,264 | 5,614 | 1,002 | 59 | 14,996 |
| 37 | 18,885 | 14,460 | 187 | 0 | 33,695 |
| 44 | 5,046 | 589 | 2 | 0 | 5,682 |
| 45 | 13,839 | 13,871 | 185 | 0 | 28,013 |
| 46 | 7,611 | 7,629 | 102 | 0 | 15,407 |
| 47 | 6,228 | 6,242 | 83 | 0 | 12,606 |
| 79 | 77,792 | 7,032 | 20 | 0 | 85,980 |
| 43 | 24,892 | 2,250 | 6 | 0 | 27,512 |
| 38 | 29,938 | 2,839 | 8 | 0 | 33,194 |
| 83 | 52,900 | 4,782 | 14 | 0 | 58,468 |
| 42 | 82,838 | 7,621 | 22 | 0 | 91,662 |
| 41 | 0 | 69 | 3,441 | 1,661 | 5,172 |

| Recoveries* | | |
|---|---|---|
| Propane | 99.38% | |
| Butanes+ | 100.00% | |
| **Power** | | |
| LNG Feed Pump | 3,552 HP | [5,839 kW] |
| LNG Product Pump | 3,622 HP | [5,955 kW] |
| Reflux Pump | 107 HP | [176 kW] |
| Residue Gas Compressor | 9,544 HP | [15,690 kW] |
| Totals | 16,825 HP | [27,660 kW] |
| **Low Level Utility Heat** | | |
| Liquid Feed Heater | 10,000 MBTU/Hr | [6,459 kW] |
| **High Level Utility Heat** | | |
| Deethanizer Reboiler | 80,220 MBTU/Hr | [51,818 kW] |
| **Specific Power** | | |
| HP-Hr/Lb. Mole | 3.253 | |
| [kW-Hr/kg mole] | | [5.348] |

*(Based on un-rounded flow rates)

A comparison of Tables III, IV, and V shows that the FIG. 5 embodiment of the present invention achieves essentially the same liquids recovery as the FIG. 3 and FIG. 4 embodiments. The FIG. 5 embodiment uses less power than the FIG. 3 and FIG. 4 embodiments, improving the specific power by over 23% relative to the FIG. 3 embodiment and nearly 9% relative to the FIG. 4 embodiment. However, the high level utility heat required for the FIG. 5 embodiment of the present invention is somewhat higher than that of the FIG. 3 embodiment (by about 8%). The choice of which embodiment to use for a particular application will generally be dictated by the relative costs of power and high level utility heat and the relative capital costs of pumps, heat exchangers, and compressors.

Other Embodiments

Figure 6:
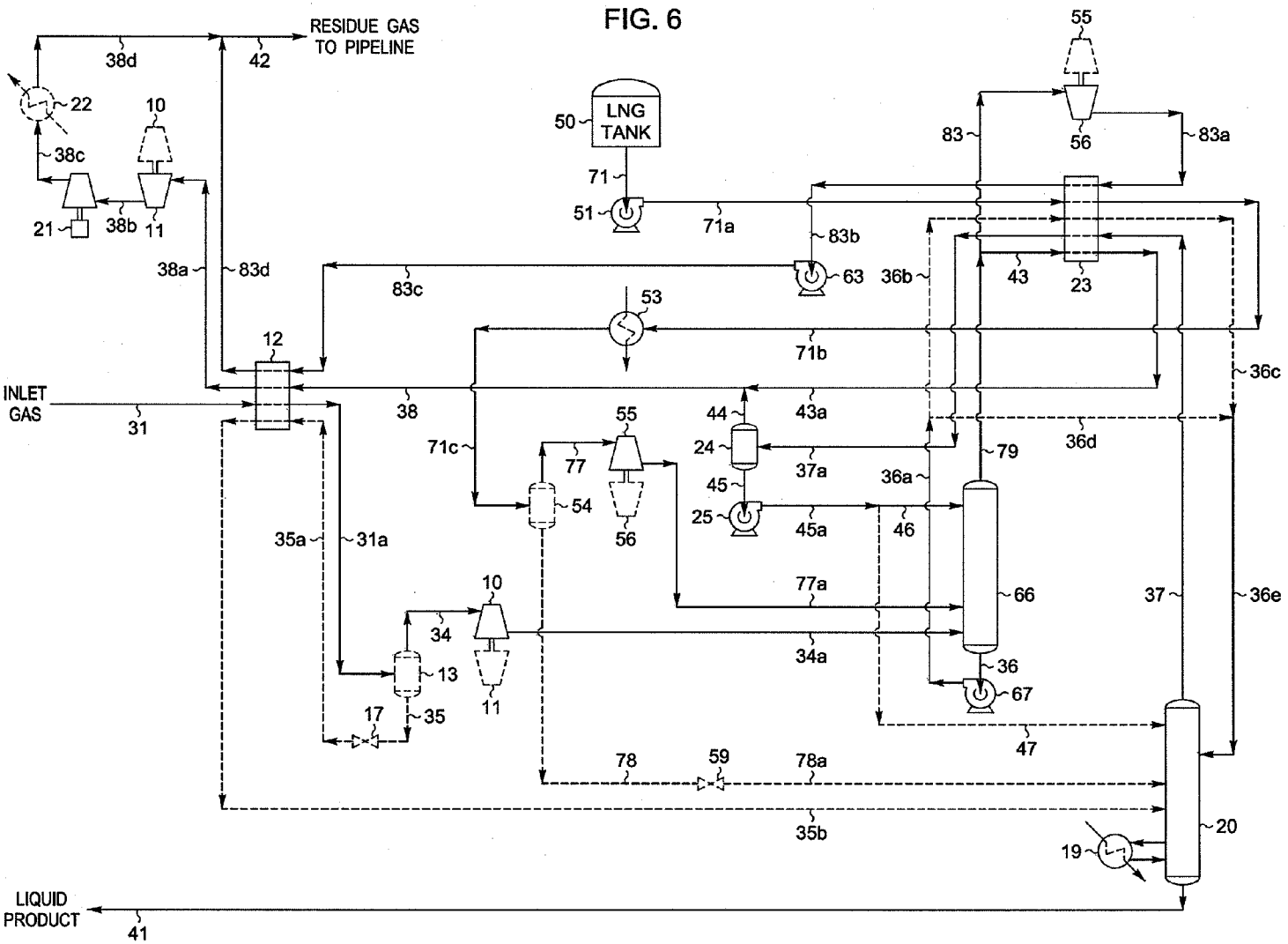
Figure 7:
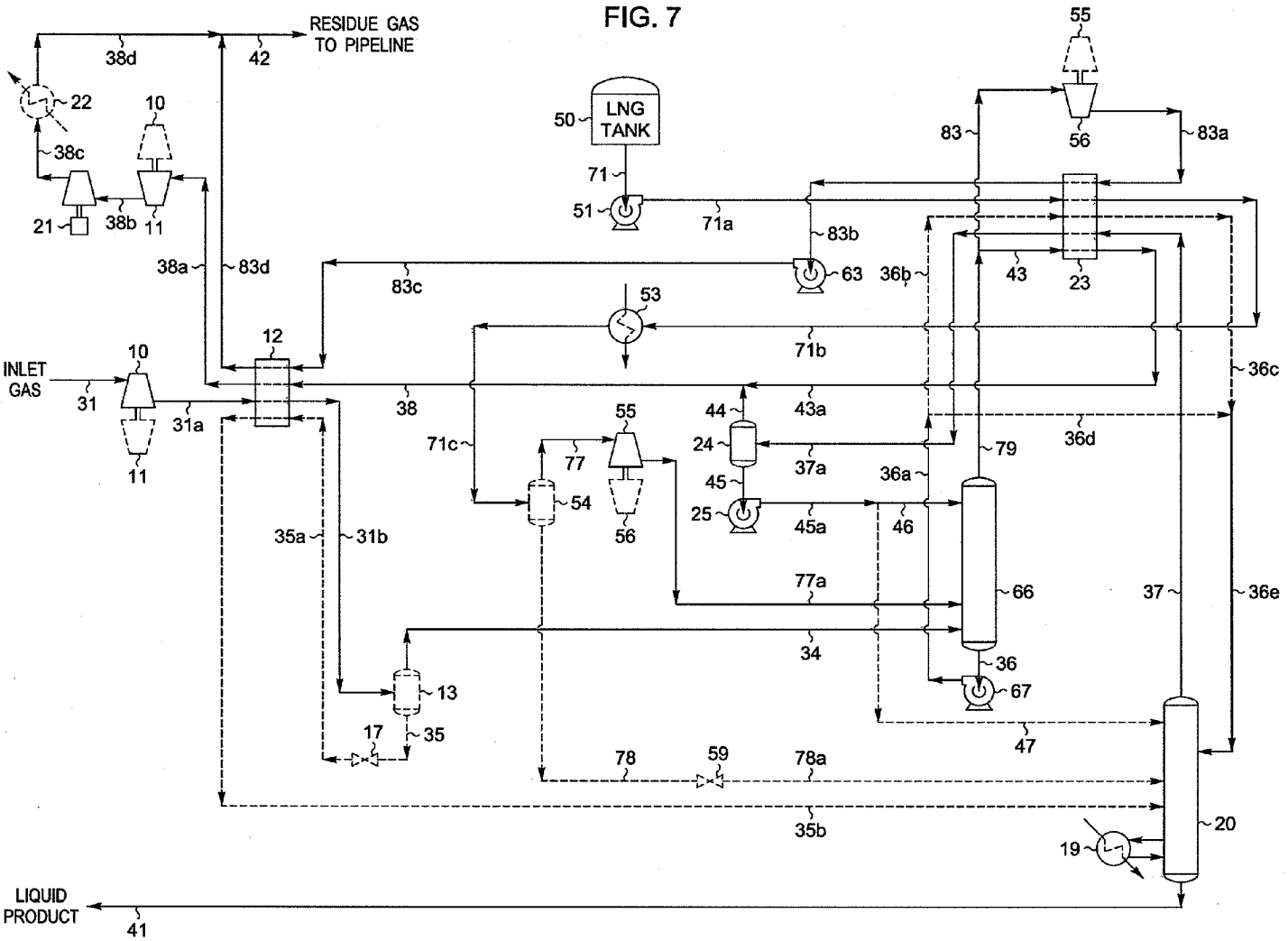
Figure 8:
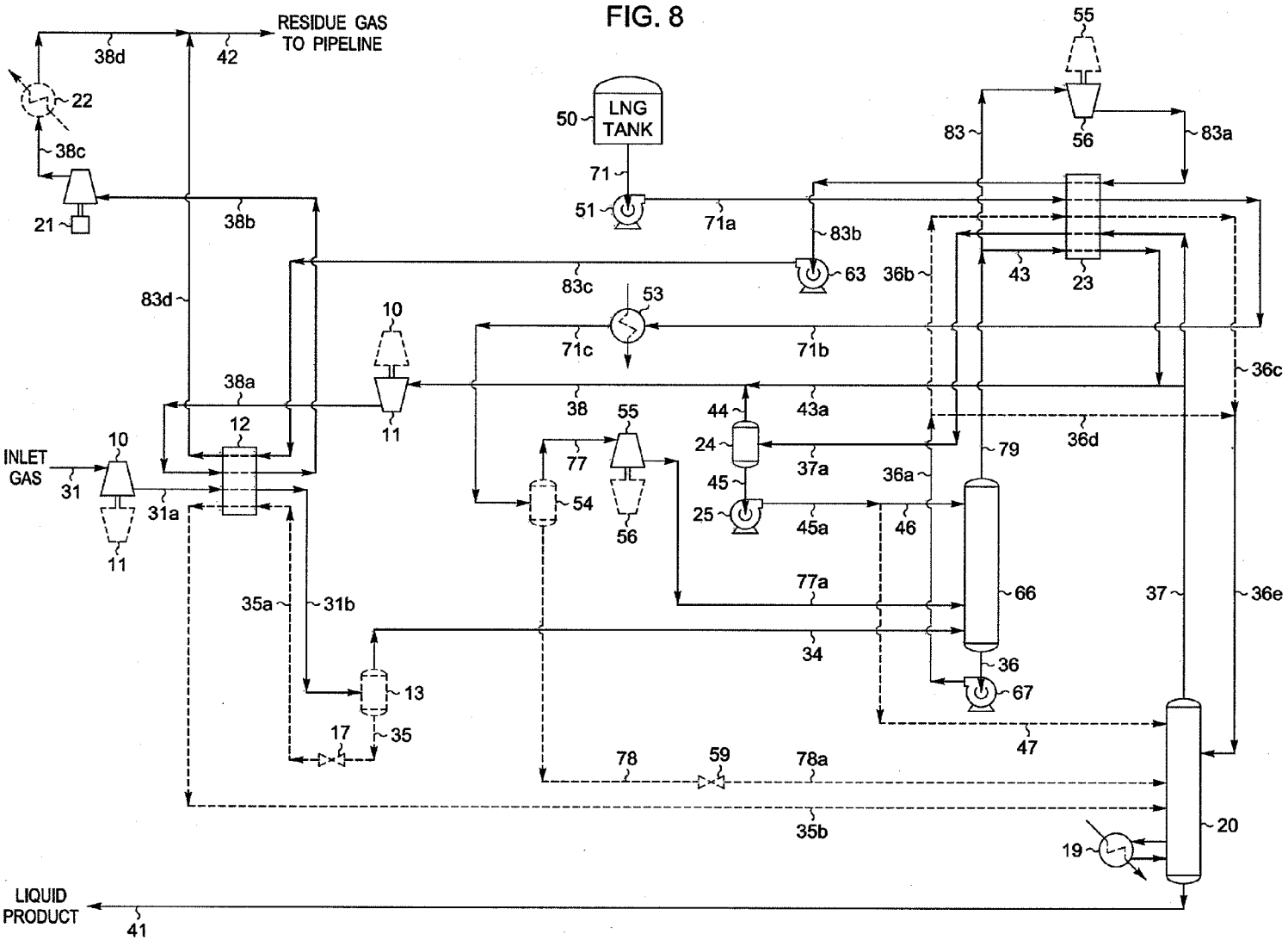

FIGS. 3 through 5 depict fractionation towers constructed in a single vessel. FIGS. 6 through 8 depict fractionation towers constructed in two vessels, absorber (rectifier) column 66 (a contacting and separating device) and stripper (distillation) column 20. In such cases, distillation vapor stream 37 is withdrawn from the upper section of stripper column 20 and routed to heat exchanger 23 to generate reflux for absorber column 66 and stripper column 20. Pump 67 is used to route the liquids (stream 36) from the bottom of absorber column 66 to heat exchanger 23 for heating and partial vaporization before feeding stripper column 20 at a mid-column feed position. The decision whether to construct the fractionation tower as a single vessel (such as deethanizer 20 in FIGS. 3 through 5) or multiple vessels will depend on a number of factors such as plant size, the distance to fabrication facilities, etc.

In accordance with this invention, it is generally advantageous to design the absorbing (rectification) section of the deethanizer to contain multiple theoretical separation stages. However, the benefits of the present invention can be achieved with as few as one theoretical stage, and it is believed that even the equivalent of a fractional theoretical stage may allow achieving these benefits. For instance, all or a part of the condensed liquid (stream 45) leaving reflux separator 24 and all or a part of streams 77*a* and 34*a* can be combined (such as in the piping to the deethanizer) and if thoroughly intermingled, the vapors and liquids will mix together and separate in accordance with the relative volatilities of the various components of the total combined streams. Such commingling of these streams shall be considered for the purposes of this invention as constituting an absorbing section.

As described earlier, the distillation vapor stream 37 is partially condensed and the resulting condensate used to absorb valuable $C_3$ components and heavier components from the vapors in streams 77*a* and 34*a*. However, the present invention is not limited to this embodiment. It may be advantageous, for instance, to treat only a portion of these vapors in this manner, or to use only a portion of the condensate as an absorbent, in cases where other design considerations indicate portions of the vapors or the condensate should bypass the absorbing section of the deethanizer.

It will also be recognized that the relative amount of feed found in each branch of the condensed liquid contained in stream 45*a* that is split between the two column feeds in FIGS. 3 through 8 will depend on several factors, including LNG pressure, inlet gas pressure, LNG stream composition, inlet gas composition, and the desired recovery levels. The optimum split cannot generally be predicted without evaluating the particular circumstances for a specific application of the present invention. It may be desirable in some cases to route all the reflux stream 45*a* to the top of the absorbing section in deethanizer 20 (FIGS. 3 through 5) or the top of absorber column 66 (FIGS. 6 through 8), with no flow in dashed line 47 in FIGS. 3 through 8. In such cases, the quantity of distillation liquid (stream 36) withdrawn from fractionation column 20 could be reduced or eliminated.

In the practice of the present invention, there will necessarily be a slight pressure difference between deethanizer 20 and reflux separator 24 which must be taken into account. If the distillation vapor stream 37 passes through heat exchanger 23 and into reflux separator 24 without any boost in pressure, reflux separator 24 shall necessarily assume an operating pressure slightly below the operating pressure of deethanizer 20. In this case, the liquid stream withdrawn from reflux separator 24 can be pumped to its feed position(s) on deethanizer 20. An alternative is to provide a booster blower for distillation vapor stream 37 to raise the operating pressure in heat exchanger 23 and reflux separator 24 sufficiently so that the liquid stream 45 can be supplied to deethanizer 20 without pumping.

When the inlet gas is leaner, separator 13 in FIGS. 3 through 8 may not be needed. Depending on the quantity of heavier hydrocarbons in the feed gas and the feed gas pressure, the cooled stream 31*a* (FIGS. 3 and 6) or expanded cooled stream 31*b* (FIGS. 4, 5, 7, and 8) leaving heat exchanger 12 may not contain any liquid (because it is above its dewpoint, or because it is above its cricondenbar), so that separator 13 may not be justified. In such cases, separator 13 and expansion valve 17 may be eliminated as shown by the dashed lines. When the LNG to be processed is lean or when complete vaporization of the LNG in heat exchangers 52 and 53 is contemplated, separator 54 in FIGS. 3 through 8 may not be justified. Depending on the quantity of heavier hydrocarbons in the inlet LNG and the pressure of the LNG stream leaving feed pump 51, the heated LNG stream leaving heat exchanger 53 may not contain any liquid (because it is above its dewpoint, or because it is above its cricondenbar). In such cases, separator 54 and expansion valve 59 may be eliminated as shown by the dashed lines.

In the examples shown, total condensation of stream 83*b* in FIGS. 3 through 8 is shown. Some circumstances may favor subcooling this stream, while other circumstances may favor only partial condensation. Should partial condensation of this stream be achieved, processing of the uncondensed vapor may be necessary, using a compressor or other means to elevate the pressure of the vapor so that it can join the pumped condensed liquid. Alternatively, the uncondensed vapor could be routed to the plant fuel system or other such use.

Feed gas conditions, LNG conditions, plant size, available equipment, or other factors may indicate that elimination of work expansion machines 10 and/or 55, or replacement with an alternate expansion device (such as an expansion valve), is feasible. Although individual stream expansion is depicted in particular expansion devices, alternative expansion means may be employed where appropriate.

In FIGS. 3 through 8, individual heat exchangers have been shown for most services. However, it is possible to combine two or more heat exchange services into a common heat exchanger, such as combining heat exchangers 23 and 53 in FIGS. 3 through 8 into a common heat exchanger. In some cases, circumstances may favor splitting a heat exchange service into multiple exchangers. The decision as to whether to combine heat exchange services or to use more than one heat exchanger for the indicated service will depend on a number of factors including, but not limited to, inlet gas flow rate, LNG flow rate, heat exchanger size, stream temperatures, etc. In accordance with the present invention, the use and distribution of the methane-rich lean LNG and residue vapor streams for process heat exchange, and the particular arrangement of heat exchangers for heating the LNG streams and cooling the feed gas stream, must be evaluated for each particular application, as well as the choice of process streams for specific heat exchange services.

Some circumstances may not require using distillation liquid stream 36 to provide cooling in heat exchanger 23, as shown by the dashed lines in FIGS. 3 through 8. In such instances, distillation liquid stream 36 may not be withdrawn at all (FIGS. 3 through 6) or may bypass heat exchanger 23 (FIGS. 6 through 8). However, it will generally be necessary to increase the heat input to column 20 by using more high level utility heat in reboiler 19, adding one or more side reboilers to column 20, and/or heating distillation liquid stream 36 by some other means. In some applications, heating just a portion (stream 36*b*) of distillation liquid stream 36 may be advantageous in the FIGS. 6 through 8 embodiments of the present invention.

In the embodiments of the present invention illustrated in FIGS. 3 through 8, lean LNG stream 83*c* is used directly to provide cooling in heat exchanger 12. However, some circumstances may favor using the lean LNG to cool an intermediate heat transfer fluid, such as propane or other suitable fluid, whereupon the cooled heat transfer fluid is then used to provide cooling in heat exchanger 12. This alternative means of indirectly using the refrigeration available in lean LNG stream 83*c* accomplishes the same process objectives as the direct use of stream 83*c* for cooling in the FIGS. 3 through 8 embodiments of the present invention. The choice of how best to use the lean LNG stream for refrigeration will depend mainly on the composition of the inlet gas, but other factors may affect the choice as well.

The relative locations of the mid-column feeds may vary depending on inlet gas composition, LNG composition, or other factors such as the desired recovery level and the amount of vapor formed during heating of the LNG stream. Moreover, two or more of the feed streams, or portions thereof, may be combined depending on the relative temperatures and quantities of individual streams, and the combined stream then fed to a mid-column feed position.

The present invention provides improved recovery of $C_3$ components and heavier hydrocarbon components per amount of utility consumption required to operate the process. An improvement in utility consumption required for operating the process may appear in the form of reduced power requirements for compression or pumping, reduced energy requirements for tower reboilers, or a combination thereof. Alternatively, the advantages of the present invention may be realized by accomplishing higher recovery levels for a given amount of utility consumption, or through some combination of higher recovery and improvement in utility consumption.

In the examples given for the FIGS. 3 through 5 embodiments, recovery of $C_3$ components and heavier hydrocarbon components is illustrated. However, it is believed that the FIGS. 3 through 8 embodiments are also advantageous when recovery of $C_2$ components and heavier hydrocarbon components is desired.

While there have been described what are believed to be preferred embodiments of the invention, those skilled in the art will recognize that other and further modifications may be made thereto, e.g. to adapt the invention to various conditions, types of feed, or other requirements without departing from the spirit of the present invention as defined by the following claims.

We claim:

1. A process for the separation of liquefied natural gas containing methane, $C_2$ components, and heavier hydrocarbon components and a gas stream containing methane, $C_2$ components, and heavier hydrocarbon components into a volatile residue gas fraction containing a major portion of said methane and said $C_2$ components and a relatively less volatile liquid fraction containing a major portion of said heavier hydrocarbon components wherein (a) said liquefied natural gas is heated sufficiently to vaporize it, thereby forming a vapor stream;

(b) said vapor stream is expanded to lower pressure and is thereafter supplied to a distillation column at a first mid-column feed position;

(c) said gas stream is expanded to said lower pressure, is cooled, and is thereafter supplied to said distillation column at a second mid-column feed position;

(d) a distillation vapor stream is withdrawn from a region of said distillation column below said expanded vapor stream and said expanded cooled gas stream, whereupon said distillation vapor stream is cooled sufficiently to at least partially condense it, forming thereby a condensed stream and a stream containing any remaining vapor, with said cooling supplying at least a portion of said heating of said liquefied natural gas;

(e) at least a portion of said condensed stream is supplied to said distillation column as a reflux stream at a top column feed position;

(f) an overhead vapor stream is withdrawn from an upper region of said distillation column and divided into at least a first portion and a second portion, whereupon said second portion is compressed to higher pressure;

(g) said compressed second portion is cooled sufficiently to at least partially condense it and form thereby a volatile liquid stream, with said cooling supplying at least a portion of said heating of said liquefied natural gas;

(h) said volatile liquid stream is heated sufficiently to vaporize it, with said heating supplying at least a portion of said cooling of said expanded gas stream;

(i) said first portion is heated, with said heating supplying at least a portion of said cooling of said distillation vapor stream;

(j) said any remaining vapor stream and said heated first portion are combined to form a residue vapor stream, and said residue vapor stream is heated, with said heating supplying at least a portion of said cooling of said expanded gas stream;

(k) said heated residue vapor stream is thereafter combined with said vaporized volatile liquid stream to form said volatile residue gas fraction containing a major portion of said methane and said $C_2$ components; and (l) the quantity and temperature of said reflux stream and the temperatures of said feeds to said distillation column are effective to maintain the overhead temperature of said distillation column at a temperature whereby the major portion of said heavier hydrocarbon components is recovered in said relatively less volatile liquid fraction by fractionation in said distillation column.

2. The process according to claim 1 wherein (a) said liquefied natural gas is heated sufficiently to partially vaporize it;

(b) said partially vaporized liquefied natural gas is separated thereby to provide said vapor stream and a liquid stream; and (c) said liquid stream is expanded to said lower pressure and thereafter supplied to said distillation column at a lower mid-column feed position.

3. The process according to claim 1 wherein (a) said gas stream is expanded to said lower pressure and is thereafter cooled sufficiently to partially condense it;

(b) said partially condensed gas stream is separated thereby to provide a further vapor stream and a liquid stream;

(c) said further vapor stream is supplied to said distillation column at said second mid-column feed position;

(d) said liquid stream is heated and is thereafter supplied to said distillation column at a lower mid-column feed position; and (e) said distillation vapor stream is withdrawn from a region of said distillation column below said expanded vapor stream and said further vapor stream.

4. The process according to claim 1 wherein (a) said liquefied natural gas is heated sufficiently to partially vaporize it;

(b) said partially vaporized liquefied natural gas is separated thereby to provide said vapor stream and a first liquid stream;

(c) said first liquid stream is expanded to said lower pressure and thereafter supplied to said distillation column at a first lower mid-column feed position;

(d) said gas stream is expanded to said lower pressure and is thereafter cooled sufficiently to partially condense it;

(e) said partially condensed gas stream is separated thereby to provide a further vapor stream and a second liquid stream;

(f) said further vapor stream is supplied to said distillation column at the second mid-column feed position;

(g) said second liquid stream is heated and is thereafter supplied to said distillation column at a second lower mid-column feed position; and (h) said distillation vapor stream is withdrawn from a region of said distillation column below said expanded vapor stream and said further vapor stream.

5. The process according to claim 1 or 2 wherein (a) said gas stream is cooled, is expanded to said lower pressure, and is thereafter supplied to said distillation column at said second mid-column feed position;

(b) said distillation vapor stream is withdrawn from a region of said distillation column below said expanded vapor stream and said cooled expanded gas stream; and (c) said volatile liquid stream is heated sufficiently to vaporize it, with said heating supplying at least a portion of said cooling of said gas stream.

6. The process according to claim 3 wherein (a) said gas stream is cooled sufficiently to partially condense it; thereby forming said further vapor stream and said liquid stream;

(b) said further vapor stream is expanded to said lower pressure and is thereafter supplied to said distillation column at said second-mid column feed position;

(c) said liquid stream is expanded to said lower pressure, is heated, and is thereafter supplied to said distillation column at said lower mid-column feed position;

(d) said distillation vapor stream is withdrawn from a region of said distillation column below said expanded first vapor stream and said expanded further vapor stream; and (e) said volatile liquid stream is heated sufficiently to vaporize it, with said heating supplying at least a portion of said cooling of said gas stream.

7. The process according to claim 4 wherein (a) said gas stream is cooled sufficiently to partially condense it; thereby forming said further vapor stream and said second liquid stream;

(b) said further vapor stream is expanded to said lower pressure and is thereafter supplied to said distillation column at said second mid-column feed position;

(c) said second liquid stream is expanded to said lower pressure, is heated, and is thereafter supplied to said distillation column at said second lower mid-column feed position;

(d) said distillation vapor stream is withdrawn from a region of said distillation column below said expanded vapor stream and said expanded further vapor stream; and (e) said volatile liquid stream is heated sufficiently to vaporize it, with said heating supplying at least a portion of said cooling of said gas stream.

8. The process according to claim 1, 2, 3, or 4 wherein (a) said residue vapor stream is compressed to higher pressure and is thereafter cooled, with said cooling providing at least a portion of said heating of said volatile liquid stream; and (b) said cooled compressed residue vapor stream is thereafter combined with said vaporized volatile liquid stream to form said volatile residue gas fraction.

9. The process according to claim 1, 2, 3, 4, 6, or 7 wherein (a) said condensed stream is divided into at least a first reflux stream and a second reflux stream;

(b) said first reflux stream is supplied to said distillation column at said top feed position; and (c) said second reflux stream is supplied to said distillation column at a mid-column feed location in substantially the same region wherein said distillation vapor stream is withdrawn.

10. The process according to claim 5 wherein (a) said condensed stream is divided into at least a first reflux stream and a second reflux stream;

(b) said first reflux stream is supplied to said distillation column at said top feed position; and (c) said second reflux stream is supplied to said distillation column at a mid-column feed location in substantially the same region wherein said distillation vapor stream is withdrawn.

11. The process according to claim 8 wherein (a) said condensed stream is divided into at least a first reflux stream and a second reflux stream;

(b) said first reflux stream is supplied to said distillation column at said top feed position; and (c) said second reflux stream is supplied to said distillation column at a mid-column feed location in substantially the same region wherein said distillation vapor stream is withdrawn.

12. The process according to claim 1, 2, 3, 4, 6, or 7 wherein a distillation liquid stream is withdrawn from said distillation column at a location above the region wherein said distillation vapor stream is withdrawn, whereupon said distillation liquid stream is heated and said heated distillation liquid stream is thereafter redirected into said distillation column at a location below the region wherein said distillation vapor stream is withdrawn.

13. The process according to claim 5 wherein a distillation liquid stream is withdrawn from said distillation column at a location above the region wherein said distillation vapor stream is withdrawn, whereupon said distillation liquid stream is heated and said heated distillation liquid stream is thereafter redirected into said distillation column at a location below the region wherein said distillation vapor stream is withdrawn.

14. The process according to claim 8 wherein a distillation liquid stream is withdrawn from said distillation column at a location above the region wherein said distillation vapor stream is withdrawn, whereupon said distillation liquid stream is heated and said heated distillation liquid stream is thereafter redirected into said distillation column at a location below the region wherein said distillation vapor stream is withdrawn.

15. The process according to claim 9 wherein a distillation liquid stream is withdrawn from said distillation column at a location above the region wherein said distillation vapor stream is withdrawn, whereupon said distillation liquid stream is heated and said heated distillation liquid stream is thereafter redirected into said distillation column at a location below the region wherein said distillation vapor stream is withdrawn.

16. The process according to claim 10 wherein a distillation liquid stream is withdrawn from said distillation column at a location above the region wherein said distillation vapor stream is withdrawn, whereupon said distillation liquid stream is heated and said heated distillation liquid stream is thereafter redirected into said distillation column at a location below the region wherein said distillation vapor stream is withdrawn.

17. The process according to claim 11 wherein a distillation liquid stream is withdrawn from said distillation column at a location above the region wherein said distillation vapor stream is withdrawn, whereupon said distillation liquid stream is heated and said heated distillation liquid stream is thereafter redirected into said distillation column at a location below the region wherein said distillation vapor stream is withdrawn.

18. The process according to claim 1 wherein (a) said distillation column is adapted to be a stripper column that produces said relatively less volatile liquid fraction from a lower region of said stripper distillation column;

(b) said expanded vapor stream is supplied at a first lower feed position to an absorber column that produces said overhead vapor stream and a bottom liquid stream;

(c) said cooled expanded gas stream is supplied to said absorber column at a second lower feed position;

(d) said bottom liquid stream is supplied to said stripper distillation column at a top column feed position;

(e) said distillation vapor stream is withdrawn from an upper region of said stripper distillation column;

(f) at least a portion of said condensed stream is supplied to said absorber column as a reflux stream at a top column feed position; and (g) the quantity and temperature of said reflux stream and the temperatures of said feeds to said absorber column and said stripper distillation column are effective to maintain the overhead temperatures of said absorber column and said stripper distillation column at temperatures whereby the major portion of said heavier hydrocarbon components is recovered in said relatively less volatile liquid fraction by fractionation in said absorber column and said stripper distillation column.

19. The process according to claim 18 wherein (a) said liquefied natural gas is heated sufficiently to partially vaporize it;

(b) said partially vaporized liquefied natural gas is separated thereby to provide said vapor stream and a liquid stream; and (c) said liquid stream is expanded to said lower pressure and thereafter supplied to said stripper distillation column at a mid-column feed position.

20. The process according to claim 18 wherein (a) said gas stream is expanded to said lower pressure and is thereafter cooled sufficiently to partially condense it;

(b) said partially condensed gas stream is separated thereby to provide a further vapor stream and a liquid stream;

(c) said further vapor stream is supplied to said absorber column at said second lower feed position; and (d) said liquid stream is heated and is thereafter supplied to said stripper distillation column at a mid-column feed position.

21. The process according to claim 18 wherein (a) said liquefied natural gas is heated sufficiently to partially vaporize it;

(b) said partially vaporized liquefied natural gas is separated thereby to provide said vapor stream and a first liquid stream;

(c) said gas stream is expanded to said lower pressure and is thereafter cooled sufficiently to partially condense it;

(d) said partially condensed gas stream is separated thereby to provide a further vapor stream and a second liquid stream;

(e) said further vapor stream is supplied to said absorber column at the second lower feed position;

(f) said first liquid stream is expanded to said lower pressure and thereafter supplied to said stripper distillation column at a first mid-column feed position; and (g) said second liquid stream is heated and is thereafter supplied to said stripper distillation column at a second mid-column feed position.

22. The process according to claim 18 or 19 wherein (a) said gas stream is cooled, is expanded to said lower pressure, and is thereafter supplied to said absorber column at said second lower feed position; and (b) said volatile liquid stream is heated sufficiently to vaporize it, with said heating supplying at least a portion of said cooling of said gas stream.

23. The process according to claim 20 wherein (a) said gas stream is cooled sufficiently to partially condense it; thereby forming said further vapor stream and said liquid stream;

(b) said further vapor stream is expanded to said lower pressure and is thereafter supplied to said absorber column at said second lower feed position;

(c) said liquid stream is expanded to said lower pressure, is heated, and is thereafter supplied to said stripper distillation column at said mid-column feed position; and (d) said volatile liquid stream is heated sufficiently to vaporize it, with said heating supplying at least a portion of said cooling of said gas stream.

24. The process according to claim 21 wherein (a) said gas stream is cooled sufficiently to partially condense it; thereby forming said further vapor stream and said second liquid stream;

(b) said further vapor stream is expanded to said lower pressure and is thereafter supplied to said absorber column at said second lower feed position;

(c) said second liquid stream is expanded to said lower pressure, is heated, and is thereafter supplied to said stripper distillation column at said second mid-column feed position; and (d) said volatile liquid stream is heated sufficiently to vaporize it, with said heating supplying at least a portion of said cooling of said gas stream.

25. The process according to claim 18, 19, 20, or 21 wherein (a) said residue vapor stream is compressed to higher pressure and is thereafter cooled, with said cooling providing at least a portion of said heating of said volatile liquid stream; and (b) the cooled compressed residue vapor stream is thereafter combined with said vaporized volatile liquid stream to form said volatile residue gas fraction.

26. The process according to claim 18, 19, 20, 21, 23, or 24 wherein (a) said condensed stream is divided into at least a first reflux stream and a second reflux stream;

(b) said first reflux stream is supplied to said absorber column at said top feed position;

(c) said bottom liquid stream is supplied to said stripper distillation column at an upper mid-column feed position; and (d) said second reflux stream is supplied to said stripper distillation column at said top column feed position.

27. The process according to claim 22 wherein (a) said condensed stream is divided into at least a first reflux stream and a second reflux stream;

(b) said first reflux stream is supplied to said absorber column at said top feed position;

(c) said bottom liquid stream is supplied to said stripper distillation column at an upper mid-column feed position; and (d) said second reflux stream is supplied to said stripper distillation column at said top column feed position.

28. The process according to claim 25 wherein (a) said condensed stream is divided into at least a first reflux stream and a second reflux stream;

(b) said first reflux stream is supplied to said absorber column at said top feed position;

(c) said bottom liquid stream is supplied to said stripper distillation column at an upper mid-column feed position; and (d) said second reflux stream is supplied to said stripper distillation column at said top column feed position.

29. The process according to claim 18, 19, 20, 21, 23, or 24 wherein at least a portion of said bottom liquid stream is heated before said bottom liquid stream is supplied to said stripper distillation column at said top column feed position.

30. The process according to claim 22 wherein at least a portion of said bottom liquid stream is heated before said bottom liquid stream is supplied to said stripper distillation column at said top column feed position.

31. The process according to claim 25 wherein at least a portion of said bottom liquid stream is heated before said bottom liquid stream is supplied to said stripper distillation column at said top column feed position.

32. The process according to claim 26 wherein at least a portion of said bottom liquid stream is heated before said bottom liquid stream is supplied to said stripper distillation column at said upper mid-column feed position.

33. The process according to claim 27 wherein at least a portion of said bottom liquid stream is heated before said bottom liquid stream is supplied to said stripper distillation column at said upper mid-column feed position.

34. The process according to claim 28 wherein at least a portion of said bottom liquid stream is heated before said bottom liquid stream is supplied to said stripper distillation column at said upper mid-column feed position.

* * * * *